US005708929A

United States Patent [19]

Adachi et al.

[11] Patent Number: 5,708,929

[45] Date of Patent: Jan. 13, 1998

[54] CONTACT CHARGING IMAGE FORMING APPARATUS HAVING IMPROVED IMAGE TRANSFER

[75] Inventors: Katsumi Adachi, Ikoma-gun; Takashi Hayakawa, Soraku-gun, both of Japan

[73] Assignee: Sharp Kabushiki Kaisha, Osaka, Japan

[21] Appl. No.: 614,762

[22] Filed: Mar. 13, 1996

[30] Foreign Application Priority Data

Mar. 14, 1995 [JP] Japan ..... 7-054788

[51] Int. Cl.[6] ..... G03G 15/30; G03G 15/16

[52] U.S. Cl. ..... 399/149; 399/175; 399/313; 399/314

[58] Field of Search ..... 355/270, 274, 355/276, 277, 271; 399/149, 150, 297, 310, 311, 313, 314, 317, 66, 168, 174, 175, 176

[56] References Cited

U.S. PATENT DOCUMENTS

| | | |
|---|---|---|
| 5,182,604 | 1/1993 | Asai . |
| 5,337,127 | 8/1994 | Imaue . |
| 5,371,578 | 12/1994 | Asomo et al. . |
| 5,420,668 | 5/1995 | Okano . |
| 5,438,397 | 8/1995 | Okana et al. . |

FOREIGN PATENT DOCUMENTS

| | | |
|---|---|---|
| 0 567 023 A3 | 10/1993 | European Pat. Off. . |
| 0 575 159 A3 | 12/1993 | European Pat. Off. . |
| 62-203182 | 9/1987 | Japan . |
| 1-292385 | 11/1989 | Japan . |
| 5-027605 | 2/1993 | Japan . |

*Primary Examiner*—S. Lee

*Attorney, Agent, or Firm*—David G. Conlin; George W. Neuner

[57] ABSTRACT

In an image forming apparatus, when a transferred material exists in a transfer position between a photoreceptor drum and a transfer unit during an image forming operation, a transfer voltage, which has opposite polarity to that of a voltage applied to a brush charger and is used for transferring a developer image on the photoreceptor drum onto the transferred material is applied to the transfer unit. Meanwhile, when a transferred material does not exist in the transfer position during the image forming operation, a non-transfer voltage, which is lower than the transfer voltage, is applied to the transfer unit. As a result, defects on an image due to returning of a developer from the brush charger to the photoreceptor drum can be prevented from being generated.

19 Claims, 28 Drawing Sheets

FIG.15(a)
a b c d e f g
h i j k l m n
o p q r s t u
v w x y z
1 2 3 4
5 6 7 8
FIG.15(b)
a b c d e f g
~~h i j~~ k l m n
o p q r s t u
v w x y z
1 2 3 4
5 ~~6~~ ~~7~~ 8
FIG.16(a)
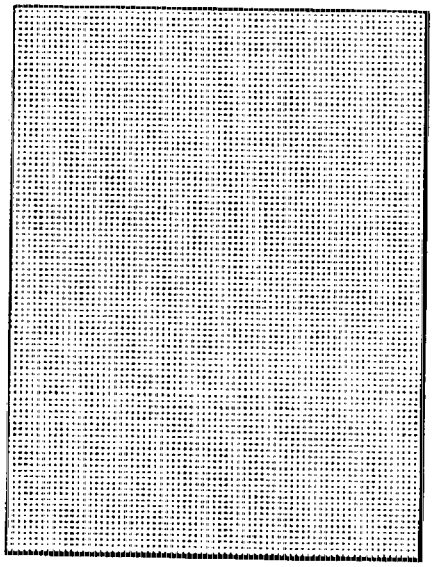
FIG.16(b)
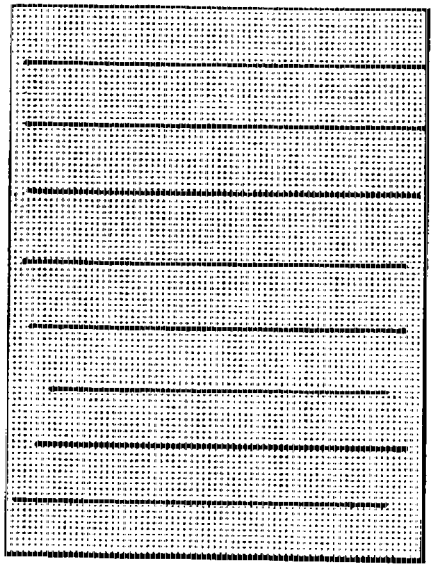

Va: CHARGE APPLIED POTENTIAL
Vo1: PHOTORECEPTOR DRUM CHARGING POTENTIAL BEFOR PASSING CHARGER WHEN SHEET EXIST
Vo3: CHARGING POTENTIAL ON AREA OF PHOTORECEPTOR WHICH DOES NOT PASS CHARGER AT STARTING

CONTACT CHARGING IMAGE FORMING APPARATUS HAVING IMPROVED IMAGE TRANSFER

FIELD OF THE INVENTION

The present invention relates to an image forming apparatus, such as a copying apparatus and printer, using an electrophotographic method.

BACKGROUND OF THE INVENTION

An image forming apparatus using an electrophotographic method electrifies a photoreceptor which is an image holder so that the photoreceptor has a prescribed potential, and exposes the photoreceptor so that an electrostatic latent image is formed. The image forming apparatus develops the electrostatic latent image using a developer, namely, toner and transfers the obtained toner image onto sheets, which are transferred material. Toner which is not transferred, namely, transfer-residual toner remains on the surface the photoreceptor after the transferring process. In a conventional image forming apparatus, the transfer-residual toner is scraped off the surface of the photoresistor by a cleaning unit provided with a cleaning blade, for example, and the scraped toner is collected into a disposal toner box in the cleaning unit.

However, the above image forming apparatus requires a special space for a cleaning unit. This prevents miniaturization of the apparatus. Moreover, in the above image forming apparatus, when printing is carried out prescribed times, the disposal toner box is full, and thus the box should be replaced. Furthermore, there arises a problem that operator's body and clothes are easily soiled by toner when replacing the box.

Therefore, in order to solve the above problem, Japanese Unexamined Patent Publication No. 62-203182/1987 (Tokukaisho 62-203182) discloses the image forming process in which transfer-residual toner is not collected into a disposal toner box using a cleaning unit after the transferring process, namely, the image forming process which does not require the cleaning unit (ie. cleanerless process). In the cleanerless process, transfer-residual toner is agitated after the transferring process, and charging and exposing processes for next image formation are carried out so that an electrostatic latent image is formed. Then, the electrostatic latent image is developed by a developer unit and simultaneously transfer-residual toner is collected.

In addition, a conventional image forming apparatus adopting an electrophotographic method is generally provided with a corona charger as a charger which electrifies a photoreceptor so that the photoreceptor has a prescribed potential. However, since the corona charger utilizing discharge phenomenon uses a high voltage, electric noises are given to another peripheral equipments, and a much amount of ozone generated at discharging make the people around the apparatus uncomfortable or such ozone deteriorates resin parts.

Therefore, instead of the corona charger, a contact charging method for electrifying a photoreceptor by making an electrically conductive charger contact with the photoreceptor is suggested. As to such a contact charging method, Japanese Unexamined Patent Publication No. 4-20986/1992 (Tokukaihei 4-20986) discloses a method where a agitating member for transfer-residual toner, which is disclosed in Japanese Unexamined Patent Publication No. 62-203182/1987 (Tokukaisho 62-203182), is used as the above-mentioned contact-type charger.

In the image forming apparatus adopting such a method has a lot of advantages, such as miniaturization of lowering a cost, improvement of safety, etc. due to an apparatus, omitting replacement of a disposal toner box, lowering a generating amount of ozone and lowering an applied voltage, by achieving the cleanerless process and the ozoneless charging.

However, in the image forming apparatus adopting the contact charging method, a charger contacts with the surface of the photoreceptor, and transfer-residual toner contacts with the charger, so the transfer-residual toner is easily attracted to the charger. Therefore, a lot of transfer-residual toner is generally stored on the charger, and the toner easily returns from the charger to the photoreceptor due to a change in a potential relationship between the surface of the photoreceptor and the charger in each processing state of the image forming apparatus. In the case where a lot of toner returns to the photoreceptor, improper exposure of the surface of the photoreceptor and insufficient cleaning may occur due to a lot of returned toner.

In other words, in the case where a small amount of toner exists on the photoreceptor, the photoreceptor can be exposed by a roundabout light by the toner at the time of exposure. Meanwhile, in the case where a lot of toner exists on the photoreceptor, since it is difficult to emit a light to the toner thereon, improper exposure occurs due to blocking of the light by the toner. If the improper exposure occurs, a potential thereof is not lowered. As a result, when the developing and cleaning processes are executed by a developer unit, the toner on the improperly exposed portion is collected into the developer unit. As a result, an image has a void section.

This phenomenon is shown in FIG. 28 in the following three cases:

(1) the case where little toner returns from the charger to the photoreceptor;

(2) the case where a lot of toner returns from the charger to the photoreceptor; and (3) an extremely lot of toner returns from the charger to the photoreceptor. In FIG. 28, a photoreceptor charging potential after passing the charger is represented by Vb, a developing potential to be applied to the developer unit by $V_{DB}$ and an exposed potion potential on the photoreceptor by $V_L$.

In FIG. 28, in the case (1), since the exposed portion potential $V_{L1}$ is enough lower than the developing potential $V_{DB}$, development is satisfactorily carried out. In the case (2), since the exposed portion potential $V_{L2}$ is only a little lower than the development potential $V_{DB}$, an amount of toner moved from the developer unit to the exposed portion is small, and image density is lowered. In the case (3), since the exposed portion potential $V_{L3}$ is not much lowered and is higher than the developing potential $V_{DB}$, the toner does not justly move from the developer unit to the exposed portion, on the contrary, the toner moves from the exposed portion to the developer unit. As a result, as shown in FIG. 29, a void section is generated on a solid-black section of an image. Similarly, such a void section is generated on a half-tone section.

In addition, in the case where a lot of toner returns from the charger to the photoreceptor, at the time of the developing and cleaning processes by the developer unit, the toner cannot be sufficiently collected to the developer unit side, and thus the cleaning process is insufficient. In the case where the cleaning process is insufficiently carried out, when the transfer-residual toner exists on a portion to be white, a blotted section is generated on an image as shown in FIG. 30. Therefore, the above-mentioned conventional image forming apparatus cannot provide a satisfactory image.

SUMMARY OF THE INVENTION

It is an object of the present invention to provide an image forming apparatus which is capable of preventing a blotted section and a void section, etc. on an image due to returning a lot of developer from a charger, which contacts with an image holder, to the image holder and thus obtaining a satisfactory image.

In order to achieve the above object, the image forming apparatus of the present invention has a photosensitive image holder, a charger for giving charge to the surface of the image holder through a contact charging member, which contacts with the image holder, so as to charge the surface of the image holder, an exposing unit for forming an electrostatic latent image by emitting a light to the surface of the charged image holder, a development cleaning unit for supplying a developer to the electrostatic latent image on the image holder so as to develop the electrostatic latent image and for collecting developer remaining on the surface of the image holder, a transfer unit and a voltage applying unit. The image forming apparatus is characterized in that the transfer unit transfers a developer image on the image holder, which is obtained by the developing process by means of the development cleaning unit, onto a transferred material using a voltage from the voltage applying unit and in that when a transferred material exists in a transfer position between the image holder and the transfer unit during image forming operation, the voltage applying unit applies a transfer voltage, which is used for transferring the developer image on the image holder onto the transferred material and which has an opposite polarity to that of a voltage applied to the contact charging member, to the transfer unit, and when a transferred material does not exist in the transfer position during image forming process, applies a non-transfer voltage, which is lower than the transfer voltage, to the transfer unit.

In accordance with the above arrangement, when a transferred material does not exist in the transfer position during the image forming operation, a voltage which is lower than the transfer voltage is applied to the transfer unit, thereby making it possible to suppress a fall in a charging potential of an image holder area which has passed the transfer position. As a result, when the image holder area passes the position of the contact charging member, it is possible to suppress returning of the developer stored on the contact charging member to the image holder. Therefore, it is possible to prevent generation of a blotted section, a void section, etc. on an image due to returning a lot of developer from the contact charging member to the image holder.

In addition, another image forming apparatus of the present invention has a photosensitive image holder, a charger for giving charge to the surface of the image holder through a contact charging member, which contacts with the image holder, so as to charge the surface of the image holder, an exposing unit for forming an electrostatic latent image by emitting a light to the surface of the charged image holder, a development cleaning unit for supplying a developer to the electrostatic latent image on the image holder so as to develop the electrostatic latent image and for collecting developer remaining on the surface of the image holder, a transfer unit, and a voltage applying unit. The image forming apparatus is characterized in that the transfer unit transfers a developer image on the image holder, which is obtained by the developing process by means of the development cleaning unit, onto a transferred material using a voltage from the voltage applying unit and in that when a transferred material exists in a transfer position between the image holder and the transfer unit during image forming operation, the voltage applying unit applies a transfer voltage, which is used for transferring the developer image on the image holder onto the transferred material and which has an opposite polarity to that of a voltage applied to the contact charging member, to the transfer unit, and when a transferred material does not exist in the transfer position during image forming operation, applies a non-transfer voltage of not lower than 0V, which has opposite polarity to that of the transfer voltage, to the transfer unit.

In accordance with the above arrangement, when a transferred material does not exist in the transfer position during the image forming operation, the non-transfer voltage of not lower than 0V which has opposite polarity to that of the transfer voltage is applied to the transfer unit, thereby making it possible to suppress a fall in a charging potential of an image holder area which has passed the transfer position similarly to the case of the above-mentioned image forming apparatus. As a result, when the image holder area passes the position of the contact charging member, it is possible to suppress returning of the developer stored on the contact charging member to the image holder. Therefore, it is possible to prevent generation of a blotted section, a void section, etc. on an image due to returning a lot of developer from the contact charging member to the image holder.

In addition, still another image forming apparatus of the present invention is characterized by having a photosensitive image holder, a charger for giving charge to the surface of the image holder through a contact charging member, which contacts with the image holder, so as to charge the surface of the image holder, an exposing unit for forming an electrostatic latent image by emitting a light to the surface of the charged image holder, a development cleaning unit for supplying a developer to the electrostatic latent image on the image holder so as to develop the electrostatic latent image and for collecting a developer remaining on the surface of the image holder, a transfer unit for transferring a developer image on the image holder, which is obtained by the developing process by means of the development cleaning unit, onto a transferred material, and a controller for controlling movement of the image holder so that a contact position on the image holder with the contact charging member passes a counter position to the development cleaning unit at least once at starting of the image forming operation.

In accordance with the above arrangement, the contact position of the image holder with the contact charging member has passed the counter position to the development cleaning unit at least once at starting the image forming operation. Therefore, electrical force and mechanical force make it possible to collect developer which returned a lot from the contact charging member to the image holder by the development cleaning unit at starting the image forming operation. As a result, it is possible to suppress generation of a defective image due to the returned developer, and thus a blotted section and a void section on an image, etc. can be prevented from being generated.

For fuller understanding of the nature and advantages of the invention, reference should be made to the ensuing detailed description taken in conjunction with the accompanying drawings.

BRIEF DESCRIPTION OF THE DRAWINGS

FIG. 12(*b*) is an explanatory drawing which shows an example of a faulty image which can be caused when only a d.c. voltage is applied to the brush charger shown in FIG. 11 which is a roller-type brush.

FIG. 15(*a*) is an explanatory drawing which shows a state of a character image which is obtained when the peak-to-peak voltage $V_{pp}$ of the charge applied voltage is lower than twice a starting voltage $V_{th}$ in the image forming apparatus shown in FIG. 11.

FIG. 15(*b*) is an explanatory drawing which shows a state of a character image which is obtained when the peak-to-peak voltage $V_{pp}$ of the charge applied voltage is higher than twice a discharge starting voltage $V_{th}$.

FIG. 16(*a*) is an explanatory drawing which shows a state of a half-tone image which is obtained when the peak-to-peak voltage $V_{pp}$ of the charge applied voltage is lower than twice a discharge starting voltage $V_{th}$ in the image forming apparatus shown in FIG. 11.

FIG. 16(*b*) is an explanatory drawing which shows a state of a half-tone image which is obtained when the peak-to-peak voltage $V_{pp}$ of the charge applied voltage is higher than twice a discharge starting voltage $V_{th}$.

FIG. 24(*b*) is a front view which shows electrically conductive cloth which is used for producing the brush charger.

FIG. 25(*b*) is a perspective view which explains a winding pattern of the brush charger.

FIG. 27(*b*) is a perspective view of the brush charger shown in FIG. 24(*a*).

DETAILED DESCRIPTION OF THE PREFERRED EMBODIMENTS

[EMBODIMENT 1]

The following describes one embodiment of the present invention in reference to FIGS. 1 through 6.

Figure 2:
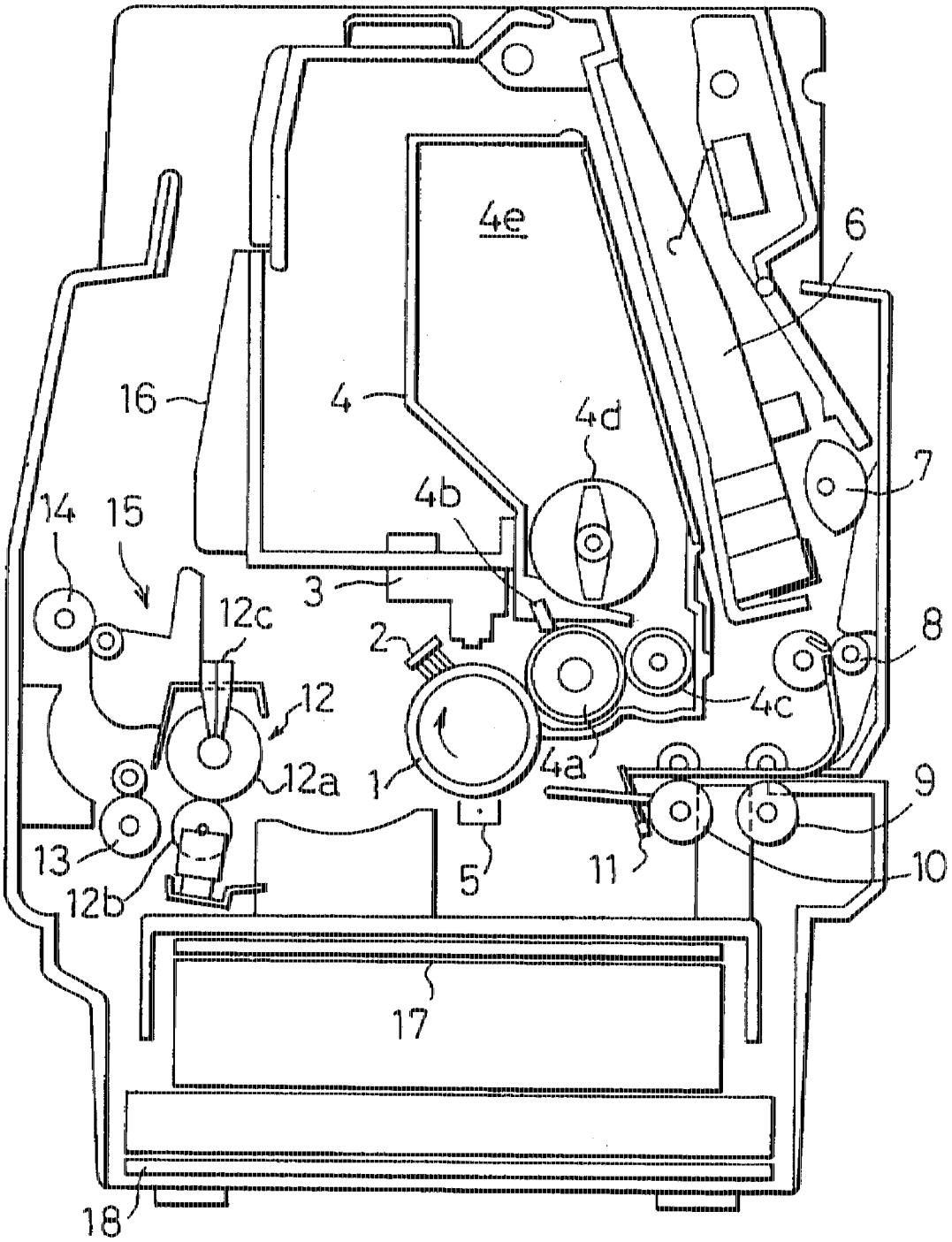
FIG. 2 is a front view which shows an overall arrangement of the image forming apparatus.

An image forming apparatus of the present embodiment has an arrangement shown in FIG. 2. As shown in FIG. 2, the image forming apparatus is provided with a photoreceptor drum 1 which is an image holder on its approximately center portion, and around the photoreceptor drum 1, a brush charger 2 as a contact charging member and a brush charging member, an exposing unit 3 as exposing means, a developer unit 4 as development cleaning means and a transfer unit 5 as transfer means are positioned. The photoreceptor drum 1 is driven by a driving mechanism, not shown, so as to be rotated at constant speed.

Figure 3:
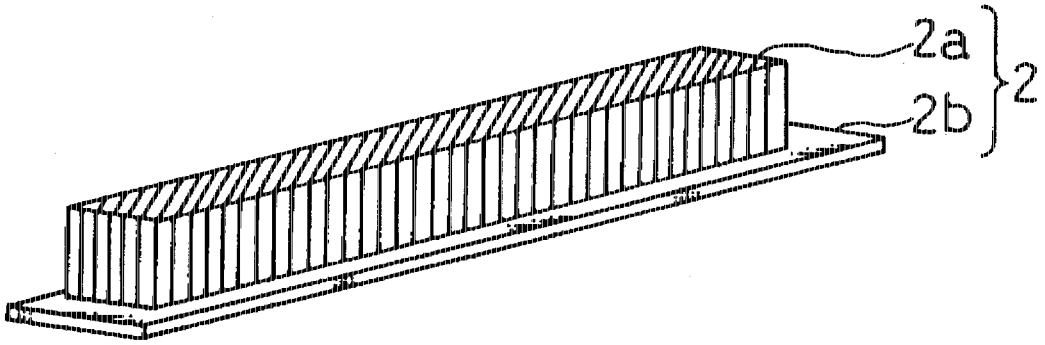
FIG. 3 is a perspective view of a brush charger shown in FIG. 1.

The brush charger 2 contacts with the surface of the photoreceptor drum 1 and electrifies so that the surface has a prescribed potential. As shown in FIG. 3, the brush charger 2 is composed of an electrically conductive substrate 2*b*, which is extended to the axial direction of the photoreceptor drum 1, and a brush section 2*a* made by electrically conductive fibers. The brush section 2*a* is made of fibers, which are obtained by dispersing carbon on rayon and adjusting an amount of carbon so that the resistant value of the fiber becomes a desired value. The brush section 2*a*, namely, the fibers, are directly transplanted into the electrically conductive substrate 2*b*, or temporarily into electrically conductive cloth and the electrically conductive cloth is stuck to the electrically conductive substrate 2*b*. In the present embodiment, the fiber length of the brush section 2*a* is set for 5 mm, and the brush section 2*a* encroaches the surface of the photoreceptor drum 1 by 1 mm.

The exposing unit 3 has a semiconductor laser, for example, and exposes the surface of the photoreceptor drum 1, which is charged to a prescribed potential, so that an electrostatic latent image is formed by the laser beam.

The developer unit 4 develops the electrostatic latent image using a developer, namely, toner so as to form a toner image. The developer unit 4 has a developing roller 4*a*, a doctor blade 4*b*, a supplying roller 4*c*, an agitating roller 4*d* and a toner filling section 4*e*. The developing roller 4*a* supplies toner to the electrostatic latent image, and the doctor blade 4*b* regulates a thickness of a toner layer on the surface of the developing roller 4*a*. The supplying roller 4*c* supplies a developer to the developing roller 4*a*, and the agitating roller 4*d* agitates toner of the toner filling section 4*e*. A monocomponent developer is filled in the toner filling section 4*e*, and this developer, namely, the toner is agitated by the agitating roller 4*d* so as to be charged. The image forming apparatus adopts reversal development, and a charging polarity of the toner is same as that of the photoreceptor drum 1.

The transfer unit 5 is composed of a corotron, and the corotron transfers the toner image, which was formed on the surface of the photoreceptor drum 1 by the developer unit 4, onto a sheet. In order to perform this transferring process, a voltage having an opposite polarity to the charging polarity of the toner is applied to the transfer unit 5.

A sheet cassette 6 for storing sheets as transferred materials, is provided on the right side of the developer unit 4 in FIG. 2. The sheets in the sheet cassette 6 is fed by a feeding roller 7 and is carried by carrying rollers 8 and 9. A paper stop roller (PS roller) 10, which feeds the sheets between the photoreceptor drum 1 and the transfer unit 5 at prescribed timing, is provided in the direction where the sheets are carried by the carrying roller 9. A paper-in sensor (Pin sensor) 11, which detects that the sheets get to the PS roller 10, is provided besides the PS roller 10.

A fixing unit 12 is provided on the left side of the photoreceptor drum 1 in FIG. 2. The fixing unit 12 is composed of a heat roller 12*a* having a heater 12*c* therein, and a pressure roller 12*b* which presses against the heat roller 12*a*. The fixing unit 12 fixes the toner image on the sheet. The sheet processed by the fixing unit 12 is carried by a carrying rollers 13 and a discharge roller 14 so as to be discharged onto a discharge section 15. The discharge section 15 is provided with a stack guide 16 that holds sheets.

An engine controller 17 and a controller 18 as control means are provided below the photoreceptor drum 1. The controller 18 is connected to a host computer, not shown, for example. The controller 18 processes image data transmitted from the host computer to data for image forming, and supplies the processed data to the exposing unit 3. The engine controller 17 control each means so that an image is formed according to signals from the controller 18.

Figure 1:
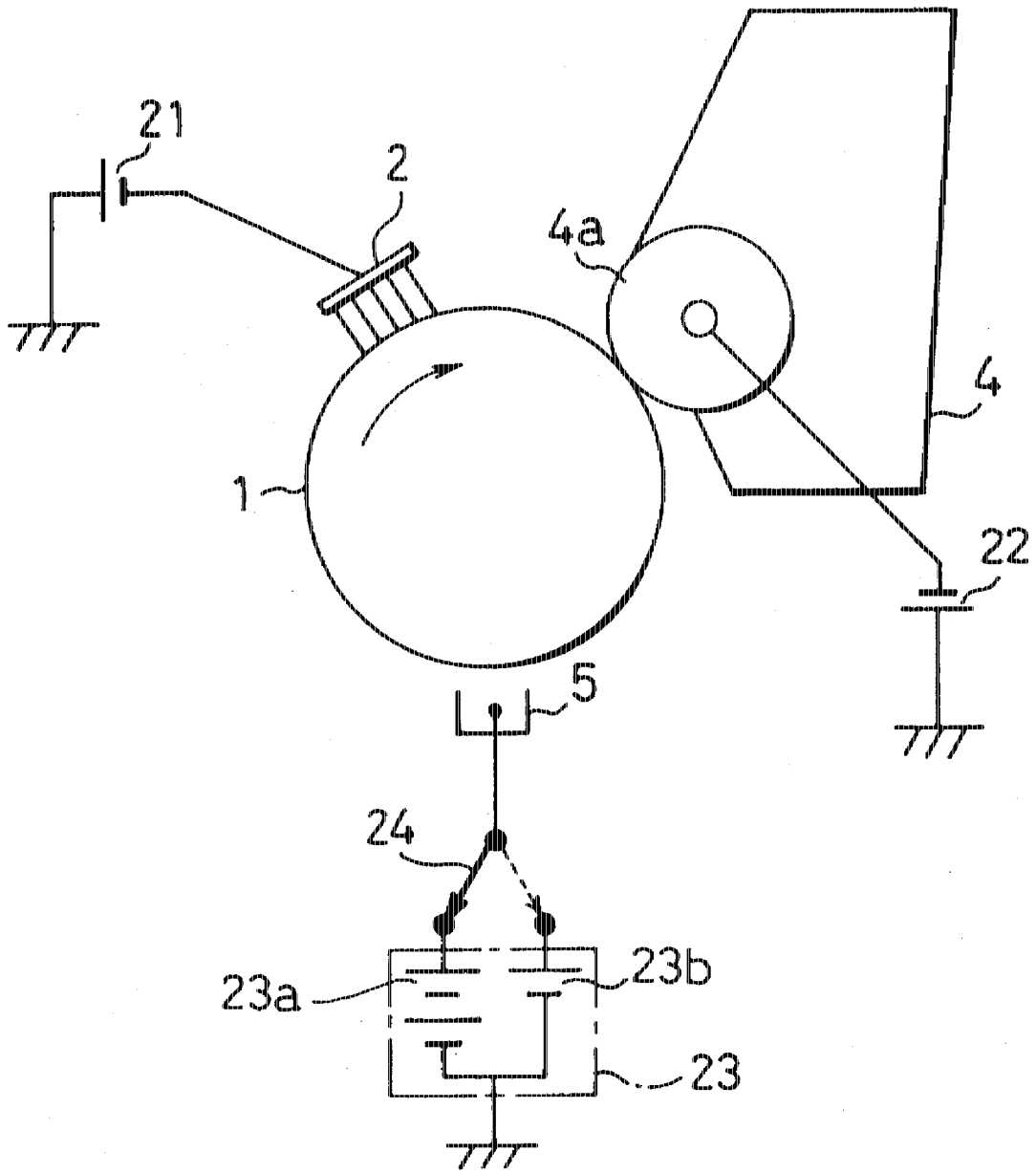
FIG. 1 is a constitutional drawing which shows a main section of an image forming apparatus according to one embodiment of the present invention.

In addition, as shown in FIG. 1, a negative voltage for charging the photoreceptor drum 1 is applied to the brush charger 2 from a power source 21 for charging, a negative voltage for a developing bias is applied to the developing roller 4*a* of the developer unit 4 from a power source 22 for development, and a positive voltage is applied to the transfer unit 5 from a power source 23 for the transfer unit. The power source 21 for charging as well as the brush charger 2 composes charging means. The power source 23 for the transfer unit can output a positive transfer voltage 23*a*, which is relatively high, or a positive non-transfer voltage 23*b*, which is lower than the transfer voltage.

The transfer voltage 23*a* is a voltage used for transferring a toner image formed on the surface of the photoreceptor drum 1 onto a sheet, namely, a general transfer voltage. Meanwhile, in the case where the non-transfer voltage 23*b* is applied when sheets do not exist between the transfer unit 5 and the photoreceptor drum 1, a potential to be used for charging the photoreceptor drum 1 is approximately equal to a potential to be used for charging the photoreceptor drum 1 in the case where the transfer voltage 23*a* is applied when sheets exist between the transfer unit 5 and the photoreceptor drum 1.

An output voltage from the power source 23 for the transfer unit is switched by a switch 24 composed of the engine controller 17. The switch 24 as well as the power source 23 for the transfer unit composes voltage applying means. The engine controller 17 also controls on/off operation for applying voltages to the respective means from the respective power sources 21 through 23.

The following describes the schematic image forming operation in the image forming apparatus with the above arrangement. When an image is formed, the photoreceptor drum 1 is rotated and its surface is uniformly charged by the brush charger 2. Then, the surface of the photoreceptor drum 1 is exposed by emission of a light from the exposing unit 3. At this time, since a potential is greatly lowered in a portion to which a light is emitted, an electrostatic latent image is obtained on the surface of the photoreceptor drum 1. The electrostatic latent image is developed by the developer unit 4. In other words, toner, which is supplied from the developing roller 4*a* of the developer unit 4 and has the same polarity as that on the surface of the photoreceptor drum 1, adheres to the portion on the photoreceptor drum 1 where the potential is lowered, and a toner image is formed.

Meanwhile, the sheets stored in the sheet cassette 6 are fed by the feeding roller 7 and are carried to the PS roller 10 by the carrying rollers 8 and 9. Then, the sheets are sandwiched by the rollers composing the PS roller 10. This is detected when the front end of the sheets contacts with the Pin sensor 11.

Next, the PS roller 10 is rotated, and the sheets are fed between the photoreceptor drum 1 and the transfer unit 5. At this time, the positive transfer voltage 23*a* is applied to the transfer unit 5 from the power source 23 for the transfer unit. Therefore, toner with negative polarity, namely, a toner image is transferred onto the sheets.

The sheets, on which the toner image was transferred, are carried to the fixing unit 12 and the toner on the sheets are fused by heat and pressed thereon. The sheets on which the toner image was fixed in such a manner are carried to the discharge section 15 by the carrying roller 13 and the discharge roller 14.

In addition, when the surface of the photoreceptor drum 1 where the transfer was completed gets to the brush charger 2, it is again charged so as to have a prescribed potential. In the case where an image is further formed, the surface of the photoreceptor drum 1 is exposed by the exposing unit 3 so that an electrostatic latent image is again formed on the photoreceptor drum 1. Then, the electrostatic latent image is developed by the developer unit 4.

At this time, in all the toner remaining on the surface of the photoreceptor drum 1 before development, toner on a portion, where the potential is not lowered due to exposure of the photoreceptor drum 1, has a higher potential (by absolute value) than a potential on the developer unit side. For this reason, such toner is moved to the developer unit 4 side and is collected by the developer unit 4. Meanwhile, since toner whose potential is lowered due to the exposure has a lower potential (by absolute value) than the potential on the developer unit side, the toner is not moved to the developer unit 4 side, and it forms a toner image with another toner moved from the developer unit 4 side. Hereinafter, the image forming operation proceeds as mentioned above.

Figure 4:
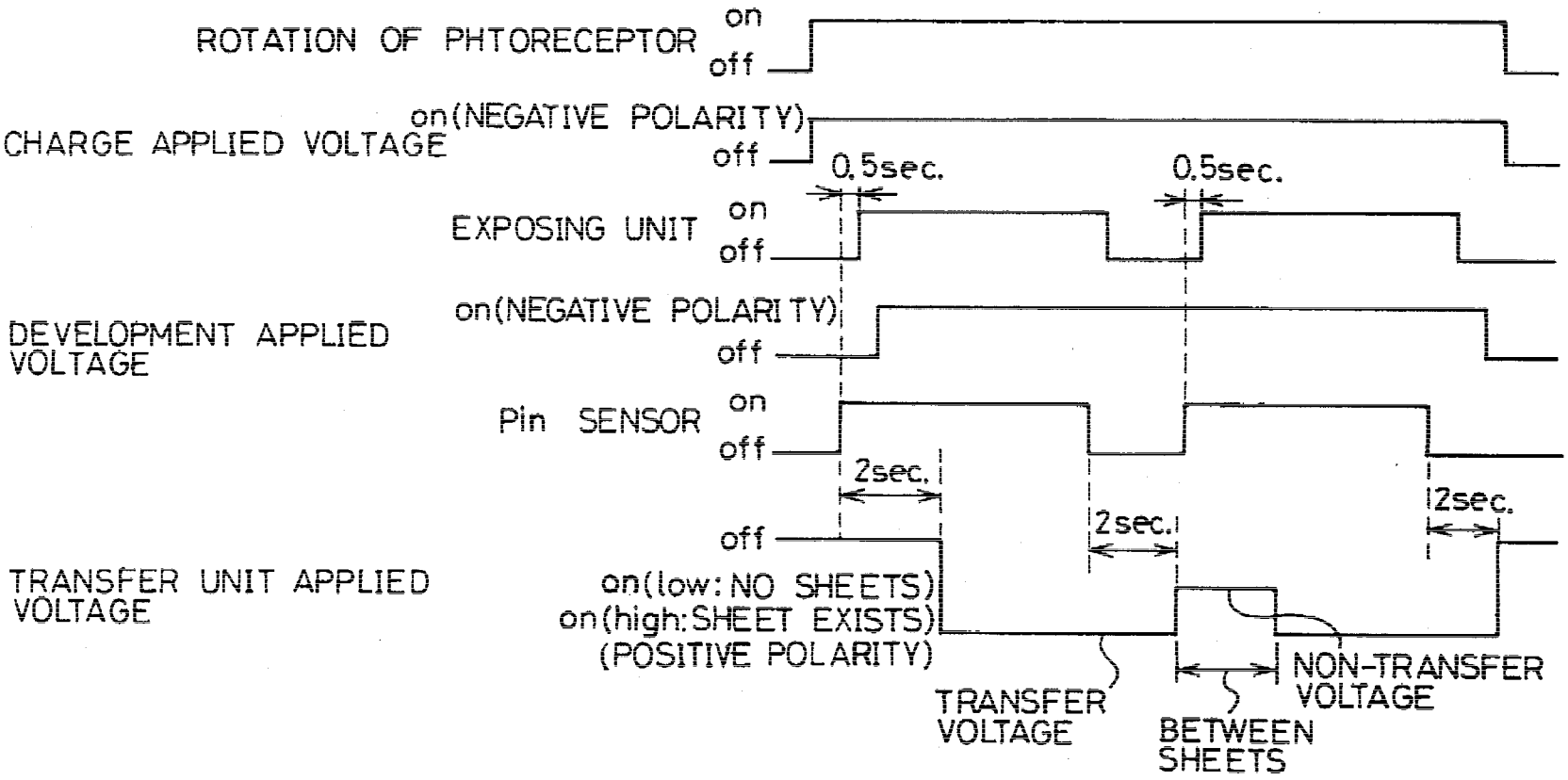
FIG. 4 is a timing chart of the image forming operation in the image forming apparatus.

The following describes process timing of the image formation in reference to FIG. 4. FIG. 4 shows a relationship among on/off timing of applying a voltage to the brush charger 2 and the developer unit 4, on/off timing of the exposing unit 3, timing of rotating/stopping the photoreceptor drum 1, on/off timing of the Pin sensor 11 and timing of applying a voltage to the transfer unit 5.

Figure 5:
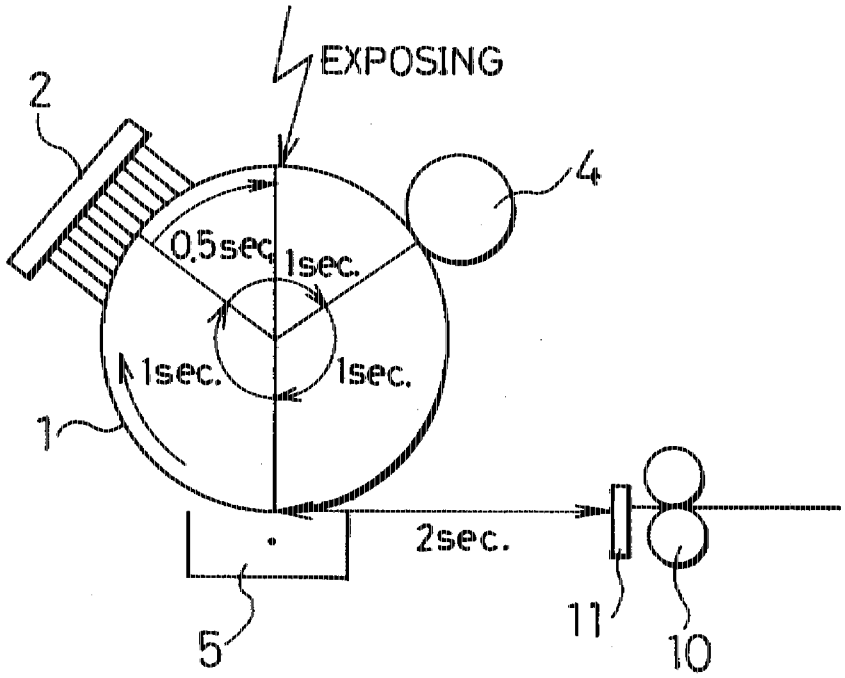
FIG. 5 is an explanatory drawing which shows rotating time of a photoreceptor drum shown in FIG. 1 between each process.

As shown in FIG. 5, as to rotating time of the photoreceptor 1 in the image forming apparatus of the present invention among each process, charging-to-exposing time is about 0.5 second exposing-to-development time is 0.5 second, development-to-transfer time is about 1 second, and transfer-to-charging is about 1 second. Moreover, sheet moving time from the Pin sensor 11 to the transfer position is 2 seconds.

As shown in FIG. 4, in the image formation, the rotation of the photoreceptor drum 1 and application of a voltage to the brush charger 2 are started at the approximately same time. Then, a sheet is fed and the Pin sensor 11 is turned on. 2 seconds later, the sheet gets to the transfer position. At this time, an exposing operation is started 0.5 second after the Pin sensor 11 is turned on so that the end of the toner image on the photoreceptor drum 1 is in the transfer position.

Successively, a developing bias is started to be applied within 0.5 second after starting of the exposing operation at the latest. Then, 1 second later, namely, 2 seconds after the Pin sensor 11 is turned on, the transfer voltage 23*a* for transferring the toner image on the photoreceptor drum 1 onto the sheet, is applied to the transfer unit 5. At this time, the sheet certainly exists in the transfer position. In such a manner, the first image forming operation is completed.

When the second image forming operation is executed successively, 2 seconds after the Pin sensor 11 is turned off, namely, after the sheet passes the transfer position, a transfer unit applied voltage is changed into the non-transfer voltage 23*b* which is lower than the transfer voltage 23*a* (by an absolute value). Then, for a few seconds, a state that sheets do not exist in the transfer position continues (ie. between-sheets-state), and thus the transfer unit applied voltage is still the non-transfer voltage 23*b*.

Thereafter, when next image forming operation is started, the Pin sensor 11 is again turned on, and 2 seconds later, the transfer unit applied voltage is again changed into the transfer voltage 23*a*.

In accordance with the above process timing, the photoreceptor area, which has passed the transfer position when sheets do not exist, is charged so as to have a potential which is approximately same as a potential, which is obtained by applying the transfer voltage 23*a* when sheets exist, namely, a potential which is approximately same when the transferring process is carried out. Therefore, when the photoreceptor area gets to the brush charger 2, an amount of returned toner from the brush charger 2 is not increased. This makes it possible to prevent a blotted section and a void section on an image at the time of continuous image forming operation from being generated. The following describes a principle of this function.

When the transferring process is carried out by the transfer unit 5, toner which is not transferred onto a sheet and remains on the surface of the photoreceptor drum 1, namely, transfer-residual toner is slightly generated. This transfer-residual toner is attracted to the brush charger 2 and stored thereon. Here, almost all the transfer-residual toner stored on the brush charger 2 is examined and it is found that the residual toner has the same polarity as that of the charging potential of the photoreceptor drum 1. Further, a more amount of the residual toner is stored in the case where the contact charger is the brush charger 2 compared to the case where the contact charger is a resin or rubber roller charger.

Figure 6:
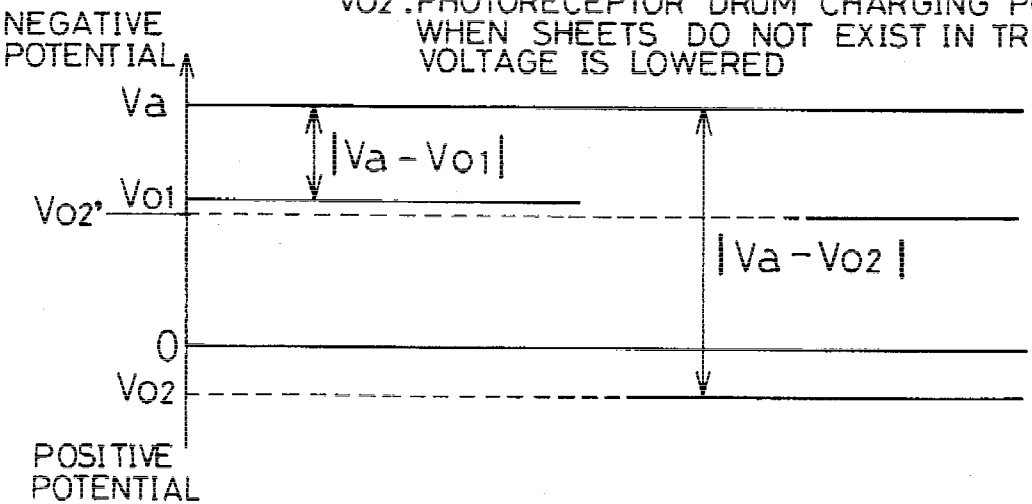
FIG. 6 is an explanatory drawing which shows a relationship between a charge applied voltage and a surface potential of the photoreceptor drum during the image forming operation in the image forming apparatus.

Meanwhile, FIG. 6 shows a relationship between a charging potential of the surface of the photoreceptor drum 1 before passing the brush charger 2 and an applied voltage to the brush charger 2. In other words, when the transfer voltage 23*a* is uniformly applied to the transfer unit 5, according to existence or non-existence of the sheets, the relationship becomes as follows:

$$|Va-Vo_1|<|Va-Vo_2|;$$

where Va is a charge applied voltage from the power source 21 for charging to the brush charger 2, $Vo_1$ is the charging potential of the photoreceptor drum 1 before passing the brush charger 2 when sheets exist in the transfer position, and $Vo_2$ is the charging potential of the photoreceptor drum 1 before passing the brush charger 2 when sheets do not exist in the transfer position.

According to the above relationship, when the photoreceptor area, which has passed the transfer position with no sheets existing, passes a charging position, the transfer-residual toner, which has the same polarity as the charging potential of the photoreceptor drum 1 and is attracted to the brush charger 2, greatly receives attracting force from the brush charger 2 to the photoreceptor area side. As a result, a great amount of toner returns from the brush charger 2 to the photoreceptor drum 1. When a great amount of toner returns to the photoreceptor drum 1, a void section and a blotted section may be generated on a transfer image onto a sheet, as mentioned above.

On the contrary, in the image forming apparatus of the present invention, during the image forming operation, when sheets exist between the transfer unit 5 and the photoreceptor drum 1, the usual transfer voltage 23*a* is applied to the transfer unit 5. Meanwhile, when sheets do not exist between the transfer unit 5 and the photoreceptor drum 1, the non-transfer voltage 23*b* is applied to the transfer unit 5. Therefore, even when sheets do not exist between the transfer unit 5 and the photoreceptor drum 1, the photoreceptor drum 1, which passed the transfer unit 5, is charged so as to have the approximately same potential as that obtained when sheets exist ($Vo_2$, shown in FIG. 6). As a result, an amount of toner to return from the brush charger 2 to the photoreceptor drum 1 is decreased, and thus a blotted section on an image of a sheet and a void section on an image due to returning of toner can be prevented from being caused.

In the present embodiment, the non-transfer voltage 23*b* is set so that the charging potential of the photoreceptor drum 1, which is obtained by applying the non-transfer voltage 23*b* when sheets do not exist between the transfer unit 5 and the photoreceptor drum 1, becomes approximately same as the charging potential of the photoreceptor drum 1, which is obtained by applying the transfer voltage 23*a* when sheets exist between the transfer unit 5 and the photoreceptor drum 1. However, when the non-transfer voltage 23*b* is set at least lower than the transfer voltage 23*a* (by an absolute value), an amount of toner to return from the brush charger 2 to the photoreceptor drum 1 can be decreased.

[EMBODIMENT 2]

Figure 7:
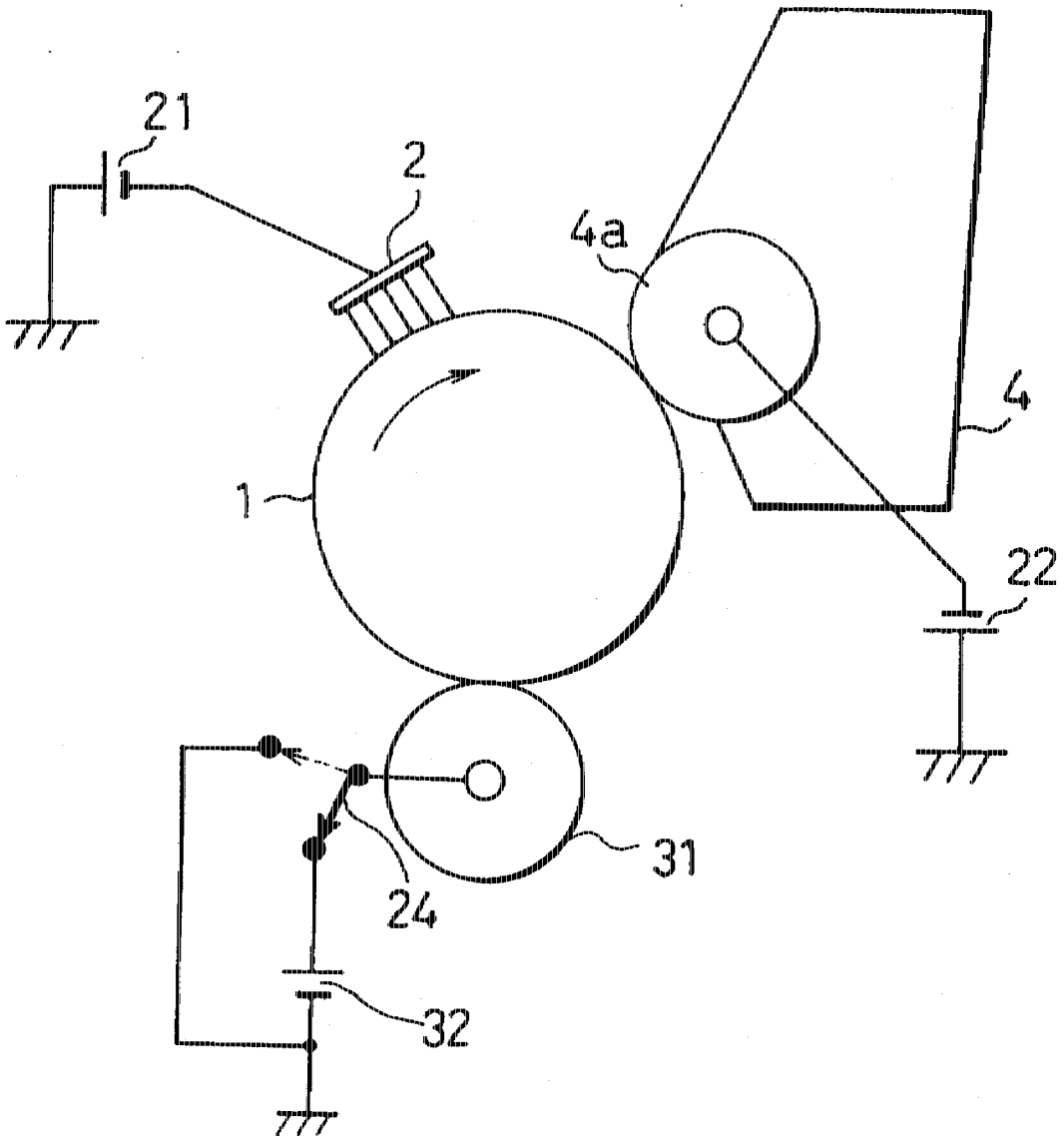
FIG. 7 is a constitutional drawing which shows a main section of an image forming apparatus according to another embodiment of the present invention.
Figure 8:
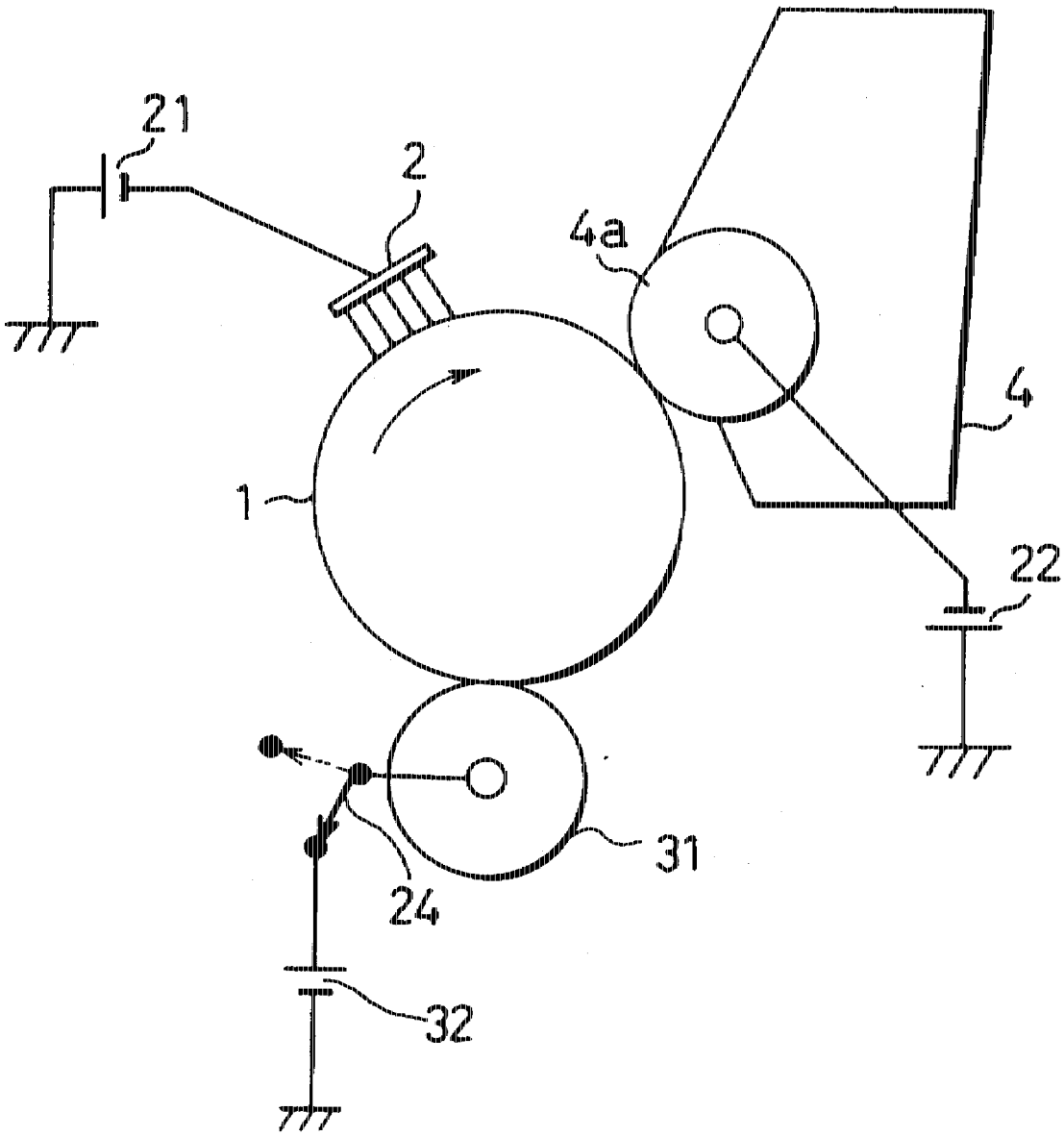
FIG. 8 is a constitutional drawing which shows another example of the arrangement shown in FIG. 7.

The following describe another embodiment of the present invention in reference to FIGS. 7 and 8. Here, for convenience of explanation, those members that have the same arrangement and functions, and that are described in the aforementioned embodiment are indicated by the same reference numerals and the description thereof is omitted.

As shown in FIG. 7, the image forming apparatus of the present embodiment is provided with a contact-type transfer unit 31 as transfer means which contacts with the photoreceptor drum 1 instead of the transfer unit 5 composed of the corotron shown in FIG. 1. As such a contact-type transfer unit 31, a roller-type transfer unit, a brush-type transfer unit or the like can be adopted. Since the contact-type transfer unit 31 generally provides better toner transferring efficiency compared to the transfer unit 5 composed of the corotron, the transfer-residual toner, namely, toner stuck to the brush charger 2 can be decreased. Therefore, the contact-type transfer unit 31 is very effective for the image forming apparatus of the present invention which adopts the cleanerless method.

A power source 32 for the transfer unit is connected to the contact-type transfer unit 31 through a switch 24. The switch 24 and the power source 32 for the transfer unit compose the voltage applying means. The power source 32 for the transfer unit applies a positive transfer voltage, which is used for transferring a toner image formed on the photoreceptor drum 1 onto a sheet, to the contact-type transfer unit 31. During the image forming operation, when sheets exist between the photoreceptor drum 1 and the contact-type transfer unit 31, as shown by a solid line in FIG. 7, the switch 24 switches the power source 32 for the transfer unit so that a prescribed transfer voltage is applied to the contact-type transfer unit 31. On the other hand, when sheets do not exist between the photoreceptor drum 1 and the contact-type transfer unit 31, as indicated by alternate long line and short dashes lines, the switch 24 switches the power source 32 for the transfer unit so that an applied voltage to the contact-type transfer unit 31 becomes 0V. In the present embodiment, in order that the applied voltage to the contact-type transfer unit 31 becomes 0V, the contact-type transfer unit 31 is grounded.

In accordance with the above arrangement, when sheets do not exist between the contact-type transfer unit 31 and the photoreceptor drum 1, charge having positive polarity which is opposite to that of toner held in the brush charger 2 is not supplied to the photoreceptor drum 1, and thus an amount of transfer-residual toner which returns from the brush charger 2 to the photoreceptor drum 1 can be decreased. As a result, similarly to the image forming apparatus mentioned in embodiment 1, a blotted section on an image of a sheet and a void section on an image due to the returning of the toner can be prevented from being generated.

In addition, in the image forming apparatus of the present invention, when sheets do not exist between the contact-type transfer unit 31 and the photoreceptor drum 1, a voltage of the power source 32 for the transfer unit is not lowered, and is 0V. Therefore, since an additional power source is not required, the arrangement is further simplified and thus the cost of the apparatus can be reduced compared to the arrangement shown in FIG. 1.

In the present embodiment, the contact-type transfer unit 31 is grounded in order that the applied voltage to the contact-type transfer unit 31 becomes 0V, but as indicated by alternate long and short dashes lines in FIG. 8, the contact-type transfer unit 31 may be in a floating state. Charge is not removed from the photoreceptor drum 1 through the contact-type transfer unit 31 in the arrangement that the contact-type transfer unit 31 is in the floating state unlike the arrangement that the contact-type transfer unit 31 is grounded. As a result, a fall in the potential of the photoreceptor drum 1 is small, so the arrangement that the contact-type transfer unit is in the floating state is preferable to the image forming apparatus of the present invention.

In addition, the arrangement, that the applied voltage to the contact-type transfer unit 31 is 0V when sheets do not exist between the contact-type transfer unit 31 and the photoreceptor drum 1, is applicable not only to the case where the contact-type transfer unit 31 is used but also to the case where the transfer unit 5 composed of the corotron shown in FIG. 1 is used.

[EMBODIMENT 3]

Figure 9:
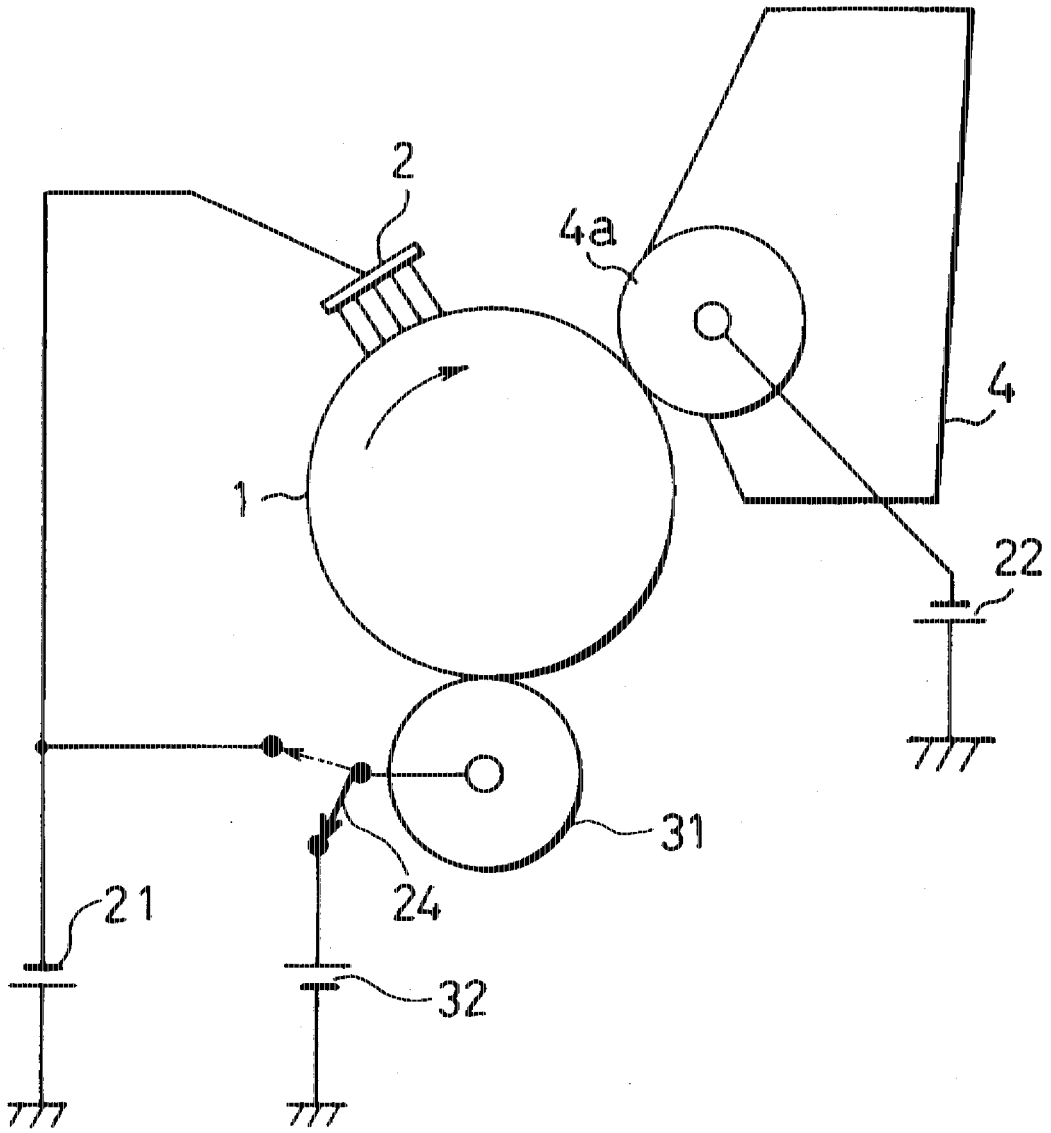
FIG. 9 is a constitutional drawing which shows a main section in an image forming apparatus according to still another embodiment of the present invention.
Figure 10:
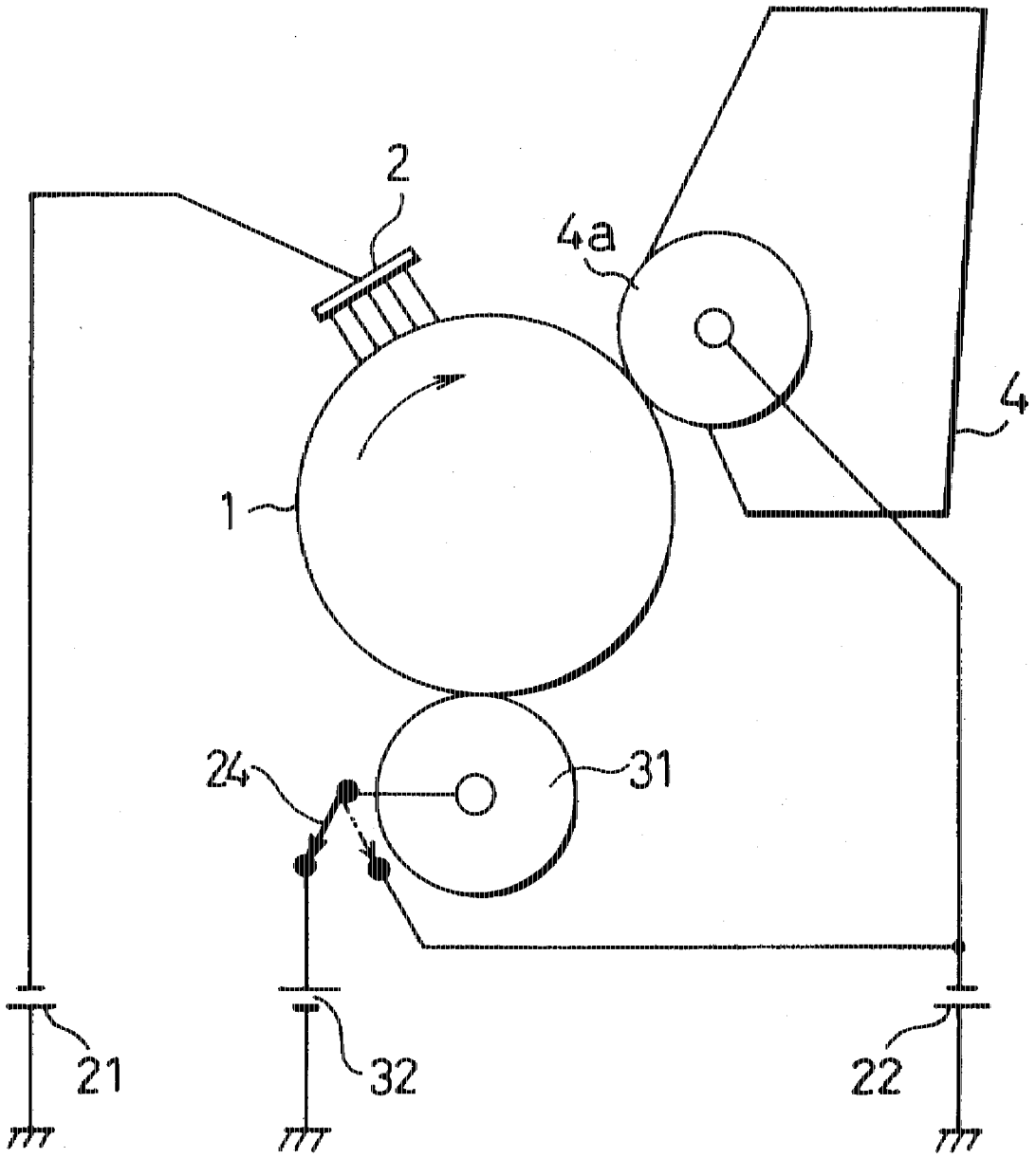
FIG. 10 is a constitutional drawing which shows another example of the arrangement shown in FIG. 9.

The following describes still another embodiment of the present invention in reference to FIGS. 9 and 10. Here, for convenience of explanation, those members that have the same arrangement and functions, and that are described in the aforementioned embodiments are indicated by the same reference numerals and the description thereof is omitted.

As shown in FIG. 9, in the image forming apparatus of the present embodiment, when sheets exist between the photoreceptor drum 1 and the contact-type transfer unit 31, as indicated by a solid line in FIG. 9, a positive transfer voltage is applied from the power source 32 for the transfer unit to the contact-type transfer unit 31. On the other hand, when sheets do not exist between the photoreceptor drum 1 and the contact-type transfer unit 31, as indicated by alternate long and short dashes line, a negative voltage having an opposite polarity to that of the transfer voltage is applied from the power source 21 for charging to the contact-type transfer unit 31. Moreover, in order to obtain such a negative voltage, the power source 21 for charging is used in the present embodiment. Therefore, in the present embodiment, the power source 21 for charging, the power source 32 for the transfer unit and the switch 24 compose the voltage applying means.

In accordance with the above arrangement, when sheets do not exist between the contact-type transfer unit 31 and the photoreceptor drum 1, charge, which has positive polarity opposite to that of toner held in the brush charger 2, is not supplied to the photoreceptor 1, and thus an amount of transfer-residual toner which returns from the brush charger 2 to the photoreceptor drum 1 can be decreased more securely. As a result, similarly to the image forming apparatus mentioned in embodiment 1, a blotted section on an image of a sheet and a void section on an image due to the returning of the toner can be prevented from being caused.

In addition, in the image forming apparatus of the present invention, when sheets do not exist between the contact-type transfer unit 31 and the photoreceptor drum 1, a voltage of the power source 32 for the transfer unit is not lowered, and a voltage which has opposite polarity to that of the transfer voltage and is obtained from the power source 21 for charging is applied to the contact-type transfer unit 31. Therefore, an additional power source is not required, and thus the arrangement can be simplified compared to the arrangement shown in FIG. 1. As a result, the cost of the apparatus can be lowered.

In the present embodiment, the power source 21 for charging is used in order that the voltage having opposite polarity to that of the transfer voltage is applied to the contact-type transfer unit 31, but as shown in FIG. 10, the power source 22 for development may be used. In this case, the power source 22 for development, the power source 32 for the transfer unit and the switch 24 compose the voltage applying means.

In addition, it is desirable that the voltage, which has opposite polarity to that of the transfer voltage and is applied to the contact-type transfer unit 31, is set so that the charging potential of the photoreceptor drum 1 charged by the opposite polarity voltage does not exceed a charging potential by the brush charger 2. This is because if the charging potential of the photoreceptor drum 1 by the contact-type transfer unit 31 exceeds the charging potential by the brush charger 2, this cannot be corrected, and thus the charging potential may be uneven.

In addition, the use of the contact-type transfer unit 31 in the image forming apparatus of the present invention makes it possible to use the power source 21 for charging and the power source 22 for development in order that the voltage having opposite polarity to that of the transfer voltage is applied to the contact-type transfer unit 31. In other words, if the transfer unit 5 composed of the corotron is used, a voltage of several kV is required for stably supplying charge by the transfer unit 5. For this reason, even if the power source 21 for charging and the power source 22 for development whose output voltages are fairly lower than the voltage of several kV are used, charge cannot be stably supplied to the transfer unit 5. Therefore, distribution of a potential of the photoreceptor drum 1 which, has not charged by the brush charger 2 yet, becomes uneven, and this causes irregularity of charging. On the contrary, when the contact-type transfer unit 31 is used, since it does not require a higher voltage, namely, the range of the voltage having opposite polarity required for the contact-type transfer unit 31 substantially coincides with the range of the voltages of the power source 21 for charging and the power source 22 for development, the power source 21 for charging or the power source 22 for development can be used.

[EMBODIMENT 4]

The following describes still another embodiment of the present invention in reference to FIGS. 11 through 18. Here, for convenience of explanation, those members that have the same arrangement and functions, and that are described in the aforementioned embodiments are indicated by the same reference numerals and the description thereof is omitted.

Figure 11:
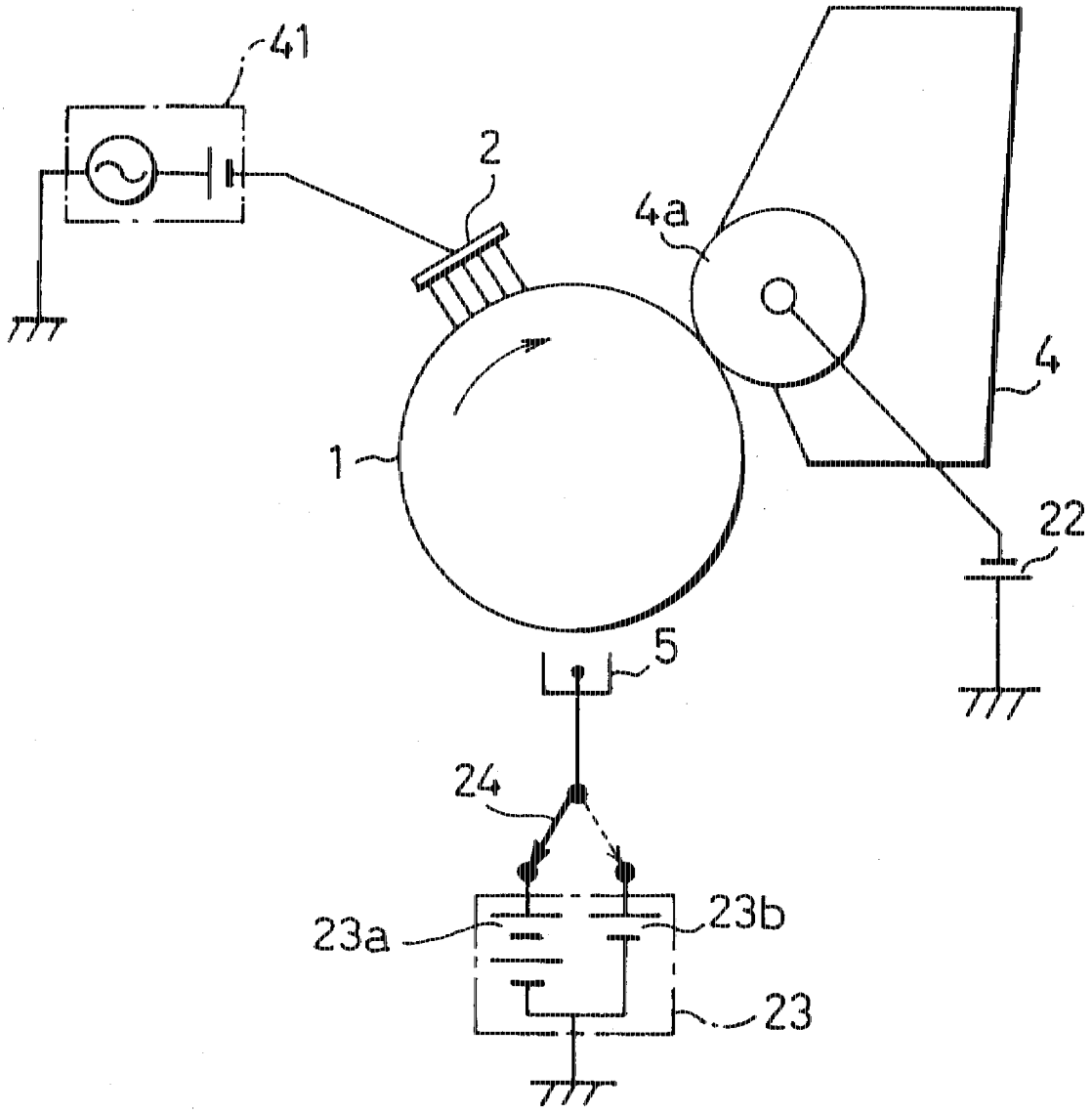
FIG. 11 is a constitutional drawing which shows a main section in an image forming apparatus according to still another embodiment of the present invention.

As shown in FIG. 11, the image forming apparatus of the present embodiment is provided with a power source 41 for charging instead of the power source 21 for charging which supplies a charge applied voltage to the brush charger 2 shown in FIG. 1. The power source 41 for charging outputs an oscillating voltage, and it as well as the brush charger 2 composes the charging means. In the present embodiment, the oscillating voltage is obtained by superposing an a.c. voltage having a peak-to-peak voltage ($V_{pp}$) of −700V on a d.c. voltage of −950V. A waveform of the a.c. voltage may be a sine wave, a triangular wave or a pulse wave, etc., so it is not necessarily limited.

When the power source 41 for charging that outputs an oscillating voltage is used, uniform charging on the surface of the photoreceptor 1 is improved, and thus a high-quality image can be obtained.

Figure 12A:
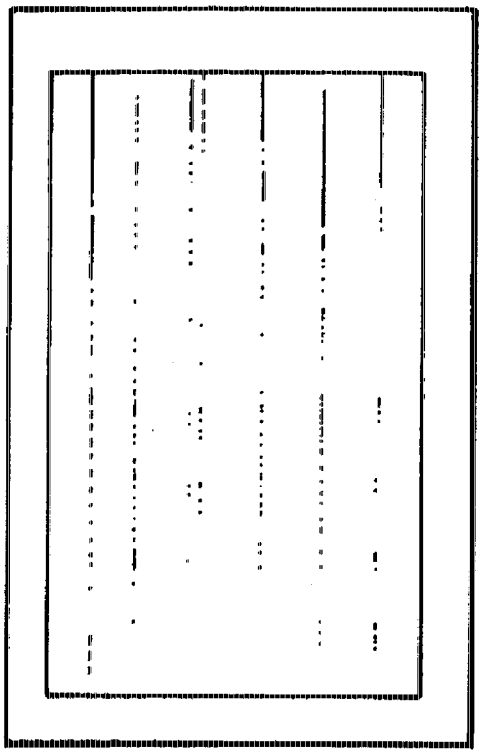
FIG. 12(*a*) is an explanatory drawing which shows an example of a faulty image which can be caused when only a d.c. voltage is applied to the brush charger shown in FIG. 11.
Figure 12B:
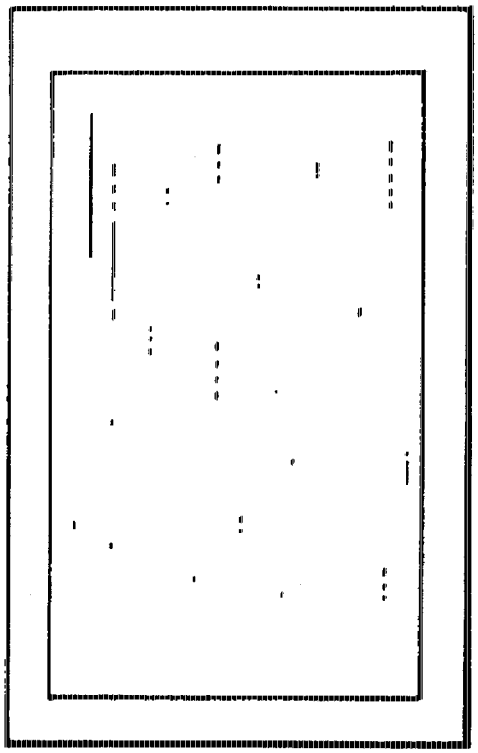

In other words, in the case where the photoreceptor drum 1 is charged by only a d.c. voltage, since charge moves only in one direction, it is occasionally difficult to uniformly electrify the photoreceptor drum 1. In this case, when the fixed brush charger 2 is used, as shown in FIG. 12(*a*), a fault on an image, such as stripes generated in the sheet carrying direction, is easily caused due to uneven charging especially on a half-tone image. In the case where the roller-type brush is used as the charger, as shown in FIG. 12(*b*), a fault, such as scratches, are easily caused on an image.

On the contrary, in the case where the oscillating voltage is applied to the brush charger 2 by the power source 41 for charging in the like manner of the image forming apparatus of the present invention, since charge is repeatedly exchanged between the brush charger 2 and the photoreceptor drum 1, the uniformity of the charging potential of the photoreceptor drum 1 is improved, and thus a high-quality image can be obtained. In the image forming apparatus especially adopting the cleanerless process, in the case where only a d.c. voltage is applied to the brush charger 2, since transfer-residual toner intervenes between the photoreceptor drum 1 and the brush charger 2, improper charging, such as excessive charging, is easily caused. Therefore, in such an apparatus, it is effective in the case where the photoreceptor drum 1 is uniformly charged to apply an oscillating voltage to the brush charger 2.

In addition, it is preferable that the peak-to-peak voltage of the oscillating voltage is higher to some degree in order to oscillate a voltage value, but when the peak-to-peak voltage is too high, black stripes are formed on an image in the perpendicular direction to the forward direction of the photoreceptor at pitch depending upon a frequency of the oscillating voltage. As a result of examining a relationship between this phenomenon and the peak-to-peak voltage, the phenomenon was remarkable when the peak-to-peak voltage became not lower than twice a discharge starting voltage from the brush charger 2 to the surface of photoreceptor drum 1. The discharge starting voltage is determined by characteristics of the brush charger 2 and the photoreceptor drum 1 and by environments around them. In the present embodiment, the discharge starting voltage is −450V.

It is considered that the above-mentioned black stripes are caused for the following reason.

Figure 13:
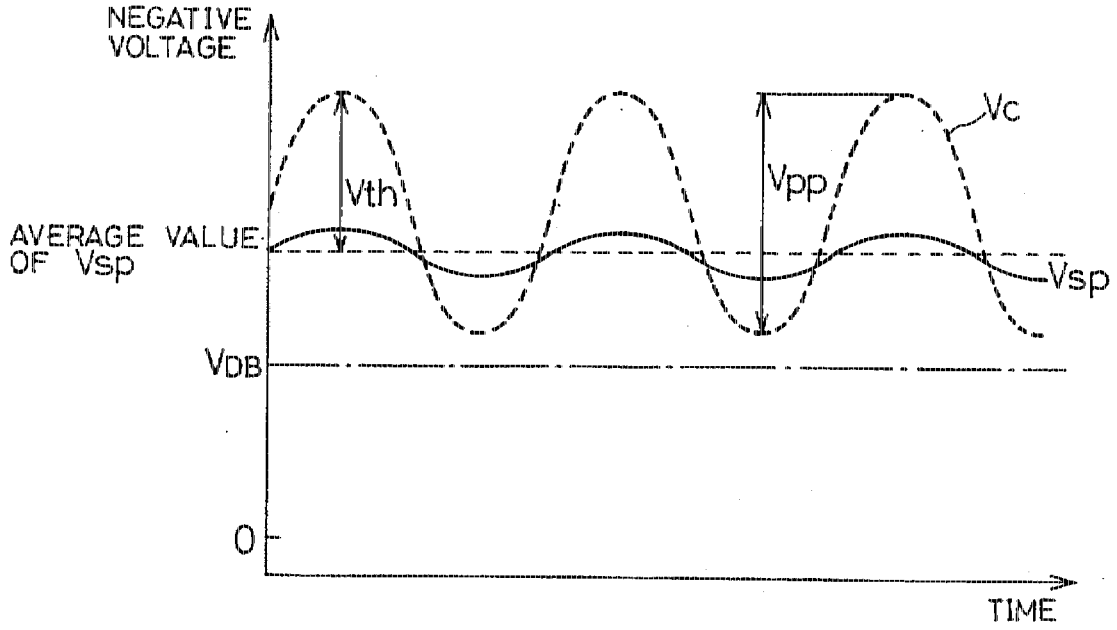
FIG. 13 is a graph which shows a relationship among a charge applied voltage $V_C$, a photoreceptor charging potential $V_{SP}$ and a developing potential $V_{DB}$ when a peak-to-peak voltage $V_{pp}$ of the charge applied voltage is lower than twice a discharge starting voltage $V_{th}$ from the brush charger to the surface of the photoreceptor drum in the image forming apparatus shown in FIG. 11.

In the case where the peak-to-peak voltage $V_{pp}$ of the oscillating voltage is lower than twice the discharge starting voltage $V_{th}$ from the brush charger 2 to the surface of the photoreceptor drum 1 like in the image forming apparatus of the present invention, as shown in FIG. 13, the photoreceptor charging potential $V_{SP}$ has a certain degree of ripple due to influence of a.c. component of the oscillating voltage Vc. It is considered that the ripple is caused due to injection of charge into the photoreceptor drum 1 from the brush charger 2. As mentioned above, when the peak-to-peak voltage $V_{pp}$ is lower than twice the discharge starting voltage $V_{th}$, ripple is caused in the photoreceptor charging potential $V_{SP}$, but this ripple is only due to the injection of charge into the photoreceptor drum 1. Therefore, the value of the ripple is small, and thus the ripple hardly influences quality of an image.

In the present embodiment, when the oscillating voltage (d.c. voltage $V_{DC}$: −950V, peak-to-peak voltage $V_{pp}$: 700V) was applied to the brush charger 2, an average value of the photoreceptor charging potential $V_{SP}$ was about −850V and the ripple was 50–60V.

Meanwhile, in the case where the peak-to-peak voltage $V_{pp}$ is not lower than twice the discharge starting voltage $V_{th}$, the ripple of the photoreceptor charging potential $V_{SP}$ becomes higher than the case where the peak-to-peak voltage $V_{pp}$ is lower than twice the discharge starting voltage $V_{th}$. The ripple causes black stripes on an image.

Japanese Examined Patent Publication No. 3-52058/1991 (Tokukohei 3-52058) discloses an idea for applying an oscillating voltage to a charger using a contact charging method. According to this publication, when a peak-to-peak voltage $V_{pp}$ becomes higher, a discharging phenomenon is concerned with the generation of the ripple of the charging potential due to an a.c. voltage, and a change in the charging potential due to the discharging phenomenon is maximumly $|V_{pp}-2V_{th}|$. In the above publication, since the discharge starting voltage becomes higher in an area where a photoreceptor and a charger are separated (separate area), the ripple of potential is cancelled as the value of $|V_{pp}-2V_{th}|$ becomes closer to 0, and the photoreceptor charging potential $V_{SP}$ becomes uniform.

Figure 14:
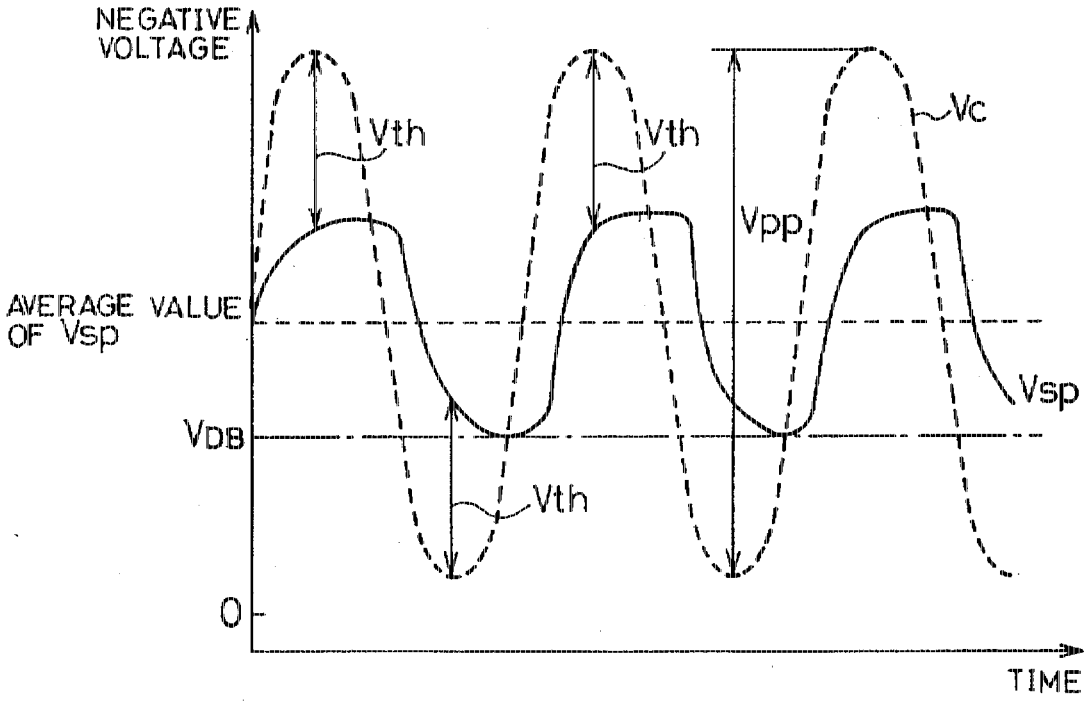
FIG. 14 is a graph which shows a relationship among a charge applied voltage $V_C$, a photoreceptor charging potential $V_{SP}$ and a developing potential $V_{DB}$ when a peak-to-peak voltage $V_{pp}$ of the charge applied voltage is higher than twice a discharge starting voltage $V_{th}$ from the brush charger the surface of the photoreceptor drum in the image forming apparatus shown in FIG. 11.

However, this mechanism works when not a brush charger but a roller charger is used. In other words, it was found that in the case where the charger was a brush-type even if the charger was roller-type, the photoreceptor charging potential $V_{SP}$ did not become sufficiently uniform by the discharging phenomenon in the separate area. For this reason, when a brush charger is used, the photoreceptor drum 1 has an area where the ripple ($V_{pp}-2V_{th}$) caused by discharge remains. Furthermore, besides this ripple, since ripple is generated due to injection of charge when $V_{pp}<2V_{th}$, as shown in FIG. 14, the photoreceptor charging potential $V_{SP}$ has fairly higher ripple on the whole.

In order to check the generation of such ripple, vibrating voltages, namely a peak-to-peak voltage $V_{pp}$ of 1500V and a d.c. voltage $V_{DC}$ of −850V were applied to the brush charger 2 so that an image was formed by using the arrangement shown in FIG. 11 of the present embodiment. As a result, the average value of the photoreceptor charging potential $V_{SP}$ became −850V, and the amplitude of ripple became approximately 600V. This is very close to the value of $|V_{pp}-2V_{th}|$(≈600V).

The following describes a result which was obtained by examining an actual image when $V_{pp}<2V_{th}$ and $V_{pp}\leqq 2V_{th}$. As to the process conditions, a developing potential $V_{DB}$ was −500V and reversal development was used.

$$V_{pp}<2V_{th} \text{ (present embodiment)} \quad (1)$$

peak-to-peak voltage $V_{pp}$: 700V d.c. voltage $V_{DC}$: −950V photoreceptor charging potential $V_{SP}$ (average value): −850V In this case, the relationship of each voltage, etc. is shown in FIG. 13. Vc is an oscillating voltage. As shown in FIG. 15(*a*), fog of a white portion (black blotting) was hardly formed on a character image. Moreover, as shown in FIG. 16(*a*), irregularity of density on a half-tone image was hardly a serious problem for practical use.

$$V_{pp}<2V_{th} \text{ (comparative example)} \quad (2)$$

peak-to-peak voltage $V_{pp}$: 1500V d.c. voltage $V_{DC}$: −850V photoreceptor charging potential $V_{SP}$ (average value): −850V In this case, the relationship of each voltage, etc. is shown in FIG. 14. The photoreceptor charging potential $V_{SP}$ occasionally became approximately same as a developing potential $V_{DB}$. As shown in FIG. 15(*b*), fog of a white portion was generated in some portion of a character image. Moreover, as shown in FIG. 16(*b*), irregularity of density was very conspicuous on a half-tone image due to influence of ripple of the photoreceptor charging potential $V_{SP}$.

Figure 17:
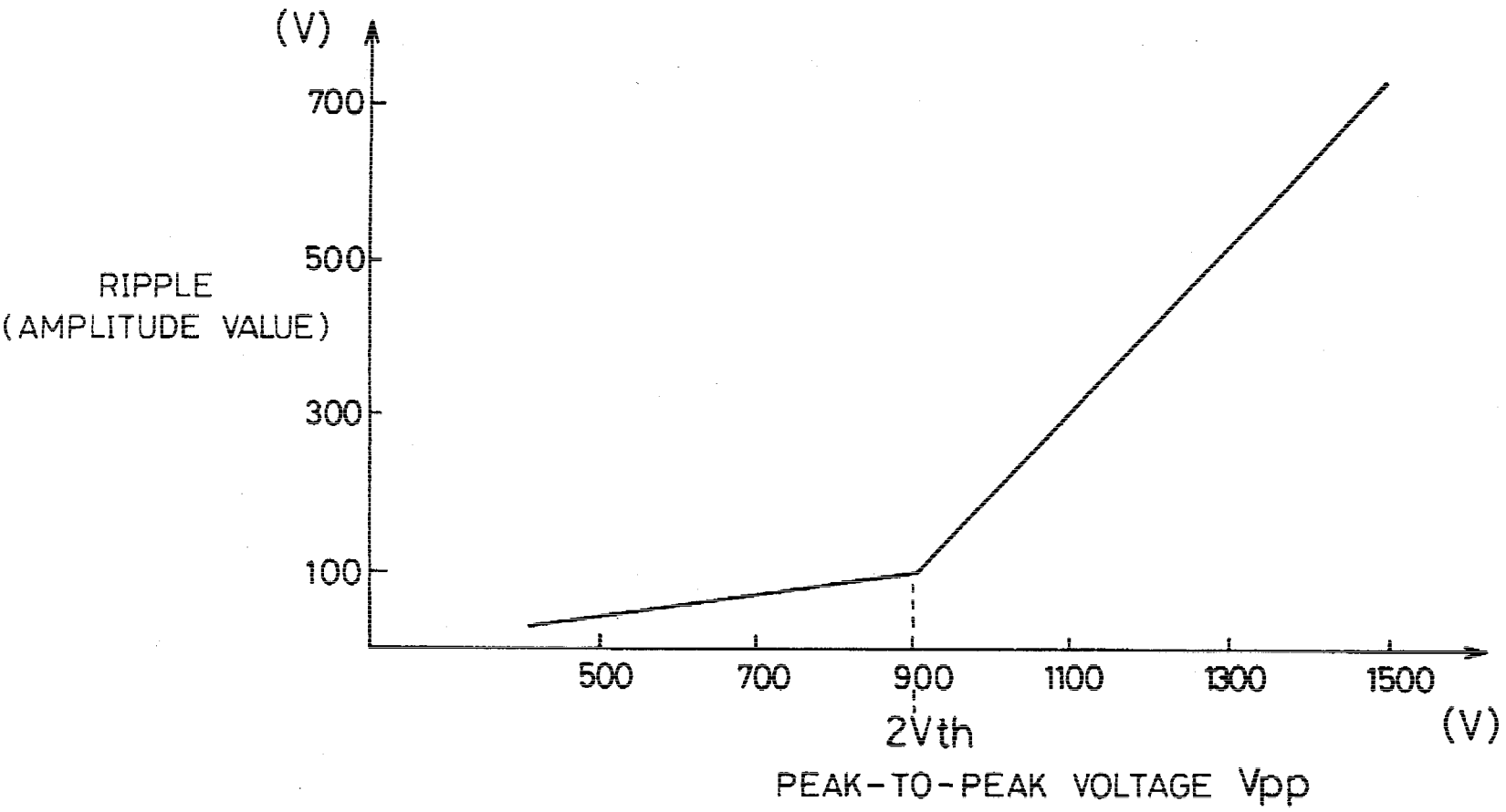
FIG. 17 is a graph which shows a relationship between the peak-to-peak voltage $V_{pp}$ and ripple of the photoreceptor charging potential $V_{SP}$.

In addition, a relationship between the peak-to-peak voltage $V_{pp}$ and ripple of the photoreceptor charging potential $V_{SP}$ was examined. Its result is shown in FIG. 17. In FIG. 17, in the area of $V_{pp}>2V_{th}$, the ripple of the photoreceptor charging potential $V_{SP}$ becomes abruptly higher. As a result, it is preferable to practical use that the $V_{pp}<2V_{th}$ in order to prevent the ripple of the photoreceptor charging potential $V_{SP}$ from increasing due to the dispersion of outputs from power sources (about 10%).

In addition, when an a.c. voltage is superposed on the applied voltage to the brush charger 2, the applied voltage can basically unify the photoreceptor charging potential $V_{SP}$. However, it is preferable that the peak-to-peak voltage $V_{pp}$ is not lower than 100V, and more preferably, not lower than 400–500V. The value of 400–500V is substantially same as that of the discharge starting voltage in the present embodiment. The reason of this is as follows.

Figure 18:
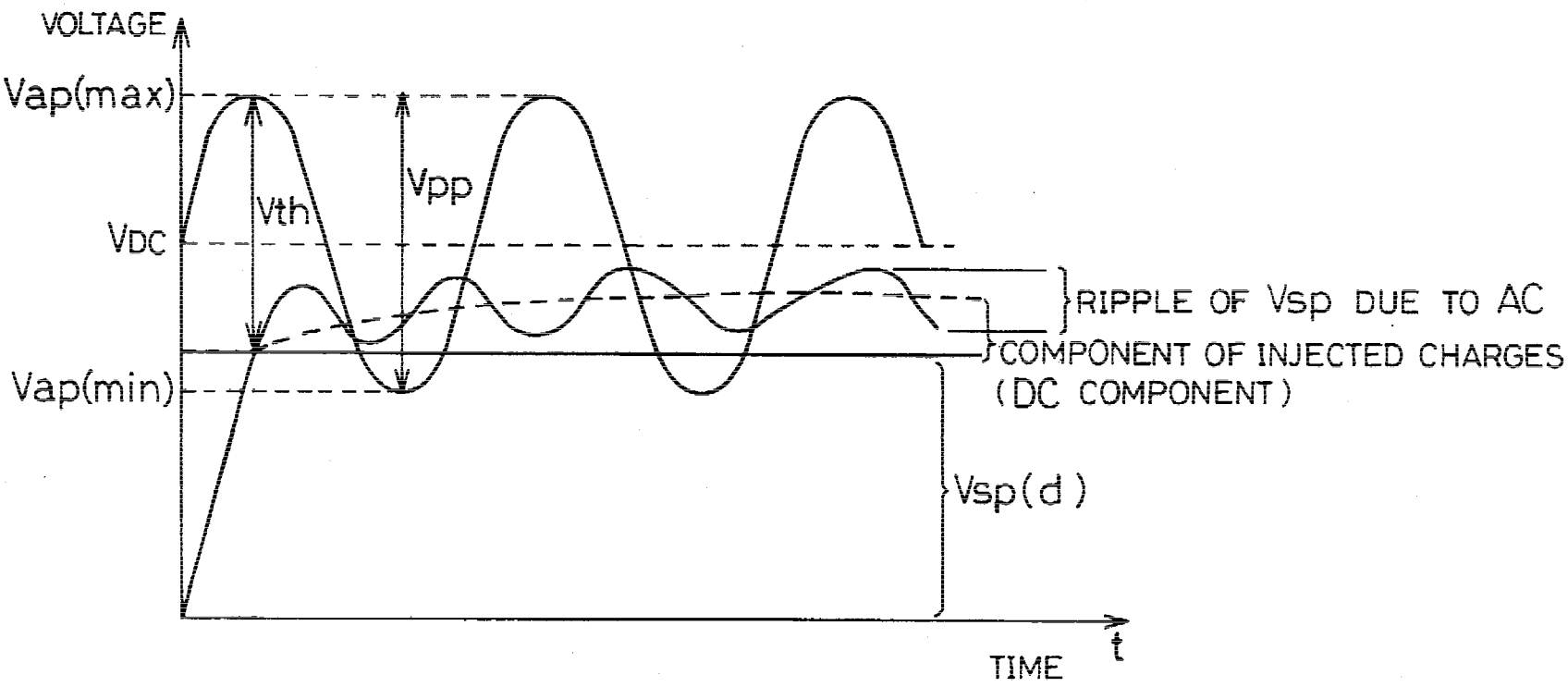
FIG. 18 is an explanatory drawing which shows a mechanism of a contact charging of the photoreceptor by an oscillating voltage.

Generally, the mechanism of contact charging is composed of a discharging phenomenon in a very small space and injection of charge, but the photoreceptor charging potential $V_{SP}$ is mainly obtained by the discharging phenomenon as shown in FIG. 18. The oscillating voltage applied to the brush charger 2, namely, the maximum value $V_{ap(max)}$ of a charge applied voltage $V_{ap}$ is obtained from the d.c. voltage $V_{DC}$ and the peak-to-peak voltage $V_{pp}$ as follows:

$$V_{ap(max)}=V_{DC}+0.5V_{pp}.$$

Moreover, the charging voltage $V_{SP(d)}$ of the photoreceptor drum 1 generated by discharge becomes as follows:

$$\begin{aligned} V_{ad(d)} &= V_{ap(max)} - V_{th} \\ &= V_{DC} + 0.5V_{pp} - V_{th}. \end{aligned}$$

When the minimum value $V_{ap(min)}$ of the charge applied voltage $V_{ap}$ becomes smaller than the above value, charge moves from the photoreceptor drum 1 to the brush charger 2.

Since $V_{ap(min)}=V_{DC}-0.5V_{pp}$, in order to fulfill the relationship: $V_{SP(d)}>V_{ap(min)}$, a relationship: $V_{pp}>V_{th}$ should hold. Under this condition, charge is exchanged a lot between the photoreceptor drum 1 and the brush charger 2, so it has an effect on unifying of the photoreceptor charging potential $V_{SP}$.

As mentioned above, the relationship: $V_{pp}$>100V is acceptable, but when the photoreceptor charging potential $V_{SP}$ abruptly rises due to improper discharge and injection of charge even if the peak-to-peak voltage $V_{pp}$ is low as mentioned above, charge moves reversely from the photoreceptor drum 1 to the brush charger 2, and thus the photoreceptor charging potential $V_{SP}$ can be made uniform.

Here, the arrangement of the present embodiment is applicable not only to the image forming apparatus shown in FIG. 11, but also the image forming apparatuses shown in FIGS. 1, 7 through 10.

[EMBODIMENT 5]

Figure 19:
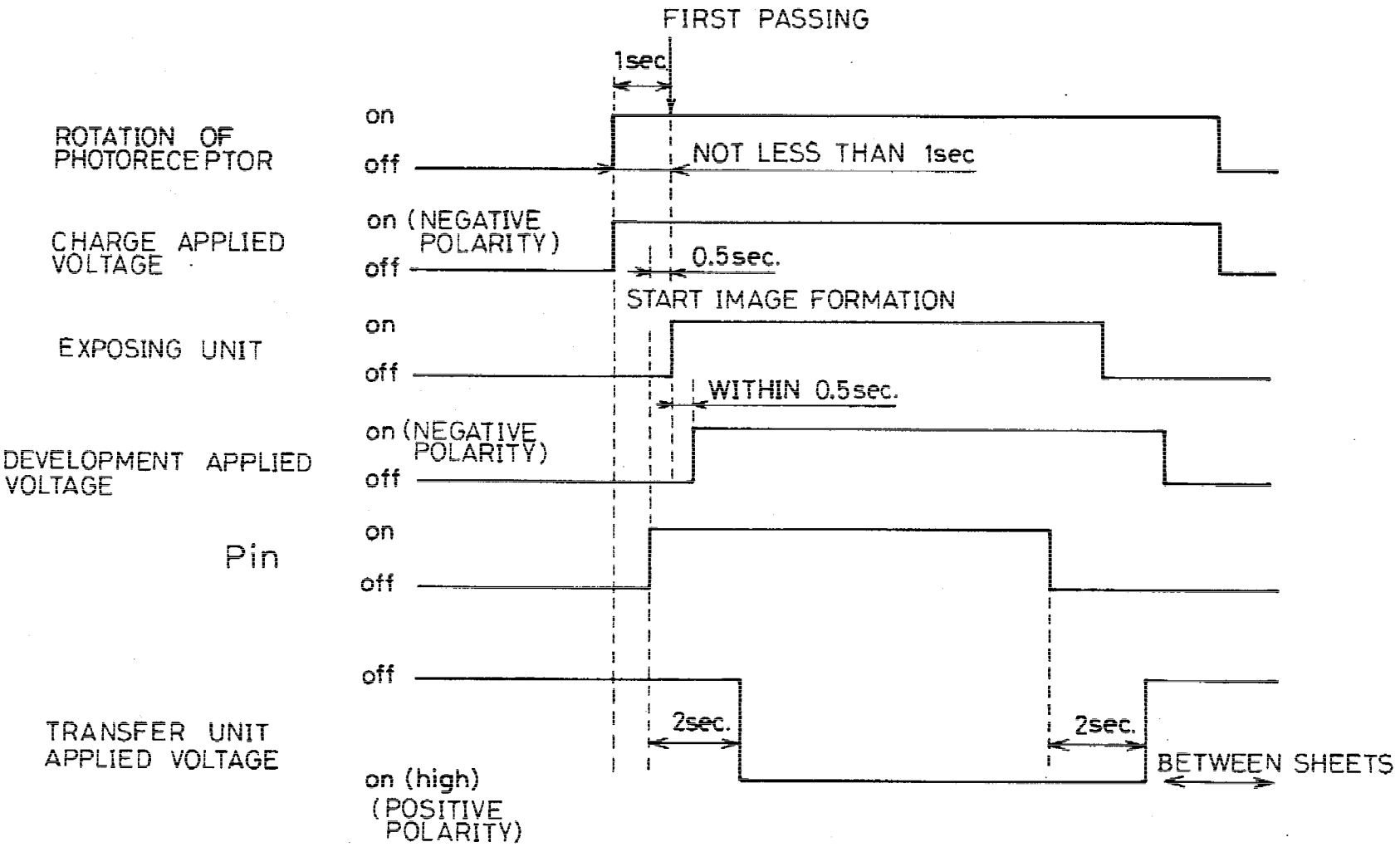
FIG. 19 is a timing chart of an image forming operation in an image forming apparatus according to still another embodiment of the present invention.
Figure 20:
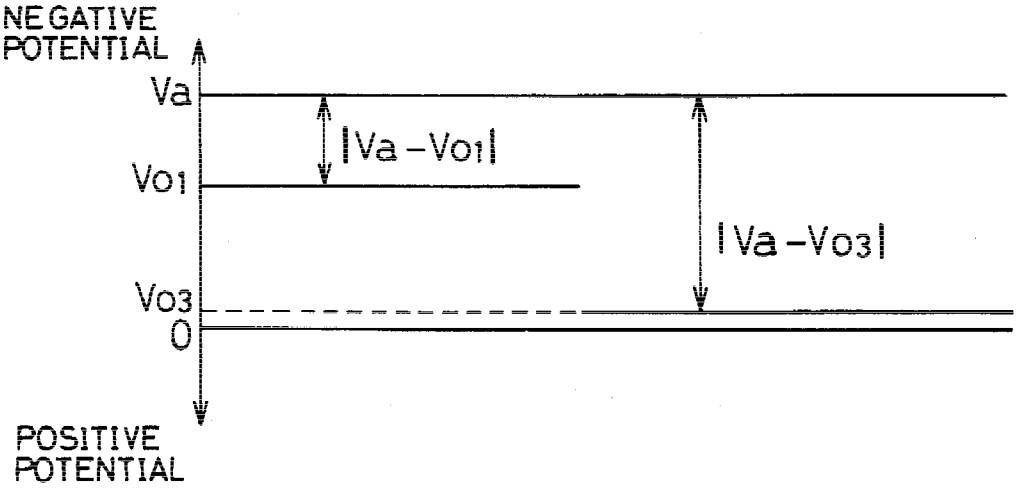
FIG. 20 is an explanatory drawing which shows a relationship between a charge applied voltage and a surface potential of a photoreceptor drum when the image forming operation is started in the image forming apparatus.
Figure 21:
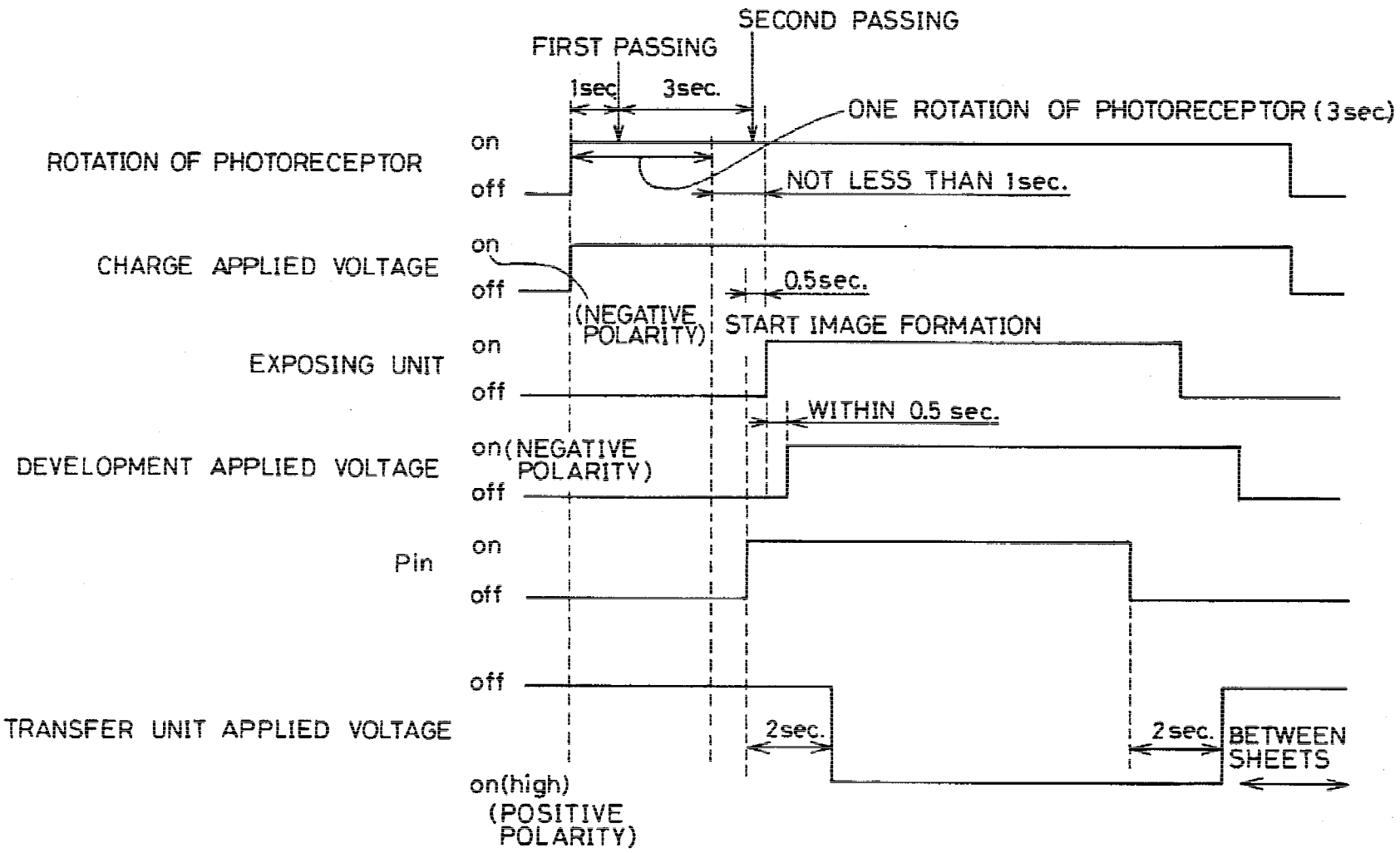
FIG. 21 is a timing chart which shows another example of the image forming operation shown in FIG. 19.

The following describes another embodiment of the present invention in reference to FIGS. 19 through 21. Here, for convenience of explanation, those members that have the same arrangement and functions, and that are described in the aforementioned embodiments are indicated by the same reference numerals and the description thereof is omitted.

As shown in FIG. 1, the image forming apparatus of the present invention is provided with each means which are same as in the image forming apparatus of the embodiment 1, but only process timing for the image forming operation is different from that in the image forming apparatus of embodiment 1. The process timing in the image forming apparatus of the present embodiment is shown in FIG. 19. FIG. 19 shows a relationship among on/off timing of applying of a voltage to the brush charger 2 and the developer unit 4, on/off timing of the exposing unit 3, timing of rotating/stopping the photoreceptor drum 1, on/off timing of the Pin sensor 11 and timing of applying a voltage to the transfer unit 5.

As shown in FIG. 19, in the image forming apparatus of the present embodiment, the photoreceptor drum 1 is rotated, and about the same time a voltage is applied to the brush charger 2. After a photoreceptor area, which came in contact with the brush charger 2 before the rotation of the photoreceptor drum 1, passes the developer unit 4, namely, is subject to the pre-rotating process, the image forming operation is started. As a result, in the image forming apparatus of the present embodiment, a satisfactory image can be obtained at the image forming operation on the first sheet. The following describes its principle. Here, the processes after the pre-rotation are same as those in the image forming apparatus of embodiment 1 shown in FIG. 4. Such control is made by the engine controller 17.

A lot of toner which adhered to the brush charger 2 returns to the photoreceptor area, which came in contact with the brush charger 2 before rotation of the photoreceptor drum 1, by electrical force and mechanical force. Examples of such mechanical force are vibration, an impact, etc. which are given to the brush charger 2. Moreover, the electrical force ia as follows.

Namely, the relationship between the charging potential of the photoreceptor drum 1 to pass the brush charger 2 and the applied voltage to the brush charger 2 is shown in FIG. 20. This relationship is as follows:

$$|Va-Vo_1|<|Va-Vo_3|,$$

where Va is a charge applied voltage from the power source 21 for charging to the brush charger 2, $Vo_1$ is a charging potential of the photoreceptor drum 1 before passing the brush charger 2 when sheets exist in the transfer position, and $Vo_3$ is a charging potential of the photoreceptor area which does not pass the brush charger 2 at the time of starting of the image forming process. According to this relationship, the transfer-residual toner, which adheres to the brush charger 2 and has the same polarity as that of the charging potential of the photoreceptor drum 1, is greatly influenced by force which attracts the residual toner from the brush charger 2 to the photoreceptor drum 1 in the photoreceptor area which has not pass the brush charger 2 at the time of starting the process, and thus returns to the photoreceptor drum 1.

When the image forming operation is started in the above state, the returned toner causes a void section and a blotted section on an image due to improper exposure. Therefore, in the image forming apparatus of the present invention, after the photoreceptor area, which came in contact with the brush charger 2 before the rotation of the photoreceptor drum 1, passes the developer unit 4, namely, the returned toner is collected into the developer unit 4 by the pre-rotating process, the image forming operation is started.

When the pre-rotating process is executed, the returned toner on the surface of the photoreceptor drum 1 is substantially collected in the developer unit 4, and thus a void section and a blotted section on an image due to improper exposure can be prevented. As a result, a satisfactory image can be obtained at the image forming operation on the first sheet and hereafter.

In addition, a lot of transfer-residual toner is stored in the brush charger 2 due to long use of the image forming apparatus. In this state, when the image forming apparatus is not used for a long time after the completion of image forming operation, an amount of toner returning from the brush charger 2 to the photoreceptor drum 1 increases. For this reason, a lot of toner is stuck to the photoreceptor area which came in contact with the brush charger 2 at starting of the image forming operation. In this case, even if the photoreceptor area which came in contact with the brush charger 2 passes the developer unit 4 only once, the returned toner on the photoreceptor drum 1 may not be satisfactorily removed. Therefore, in order to avoid the above problem, it is desirable that the photoreceptor area, which came in contact with the brush charger 2, passes the developer unit 4 not lower than twice in the pre-rotating process as shown in FIG. 21.

The arrangement of the present embodiment is applicable not only to the image forming apparatus shown in FIG. 1 but also to the image forming apparatuses shown in FIGS. 7 through 11.

[EMBODIMENT 6]

Figure 22:
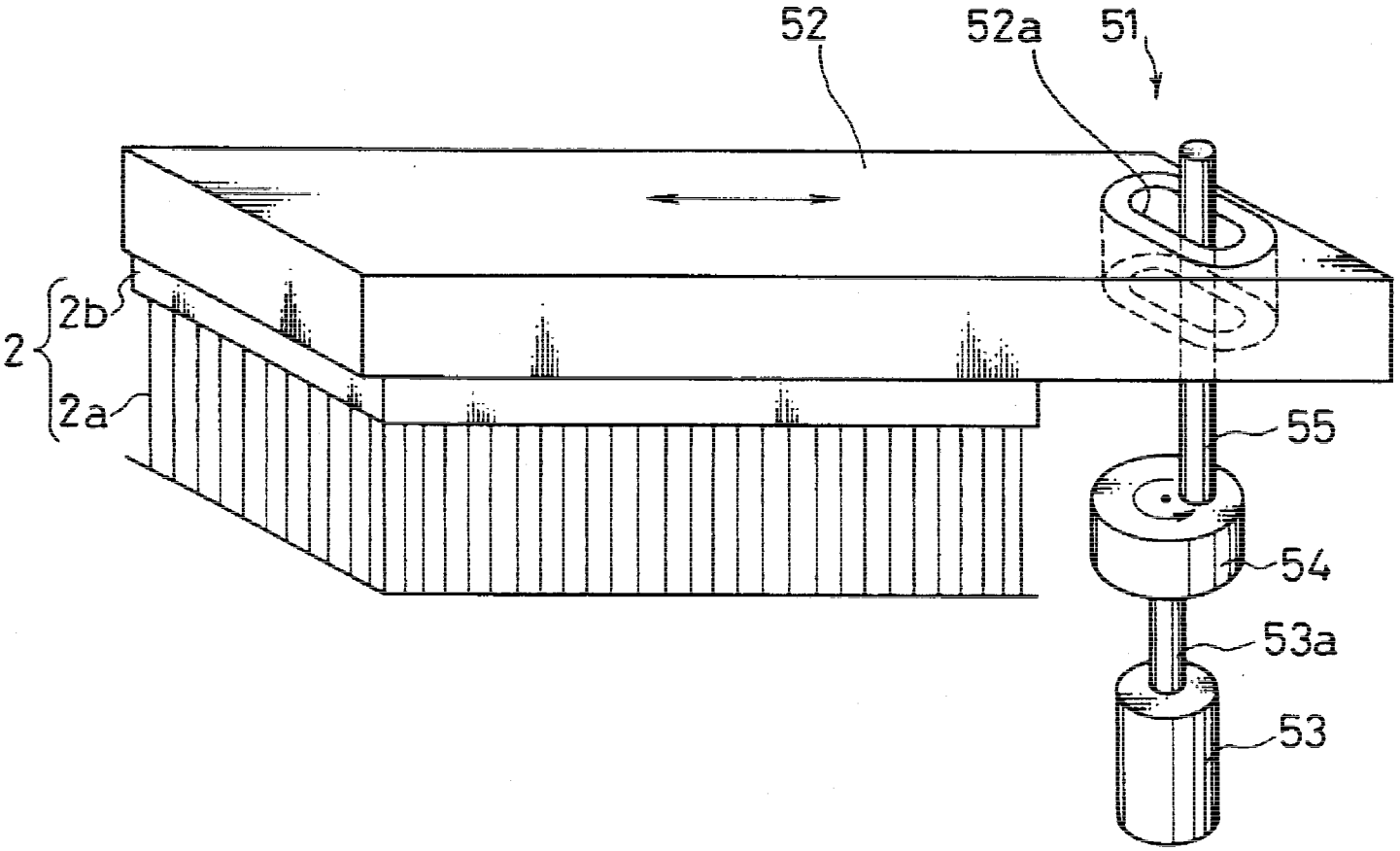
FIG. 22 is a perspective view which shows the brush charger and its driving unit provided to an image forming apparatus according to still another embodiment of the present invention.

The following describes still another embodiment of the present invention in reference to FIG. 22. Here, for convenience of explanation, those members that have the same arrangement and functions, and that are described in the aforementioned embodiments are indicated by the same reference numerals and the description thereof is omitted.

In the image forming apparatus of the present embodiment, the brush charger 2 shown in FIG. 3 is vibrated in the axial direction of the photoreceptor drum 1 by a brush driving unit 51 shown in FIG. 22 as brush vibrating means.

The brush driving unit 51 is provided with a brush stand 52, a motor 53 for vibrating, a rotor 54 mounted to a driving shaft 53*a* of the motor 53 for vibrating, and a drive transmitting shaft 55 mounted to the rotor 54. An electrically conductive substrate 2*b* of the brush charger 2 is mounted to the rear face of the brush stand 52. The drive transmitting shaft 55 is parallel to the driving shaft 53*a*, and the drive transmitting shaft 55 and the driving shaft 53*a* are not co-axial. The top of the drive transmitting shaft 55 is inserted into a slot 52*a* formed in the brush stand 52. The slot 52*a* is formed so that its lengthwise direction is parallel to the direction that perpendicularly intersects the axial direction of the photoreceptor drum 1, and the drive transmitting shaft 55 can move to the lengthwise direction in the slot 52*a*.

In accordance with the arrangement of the brush driving unit 51, when the motor 53 for vibrating rotates, the brush stand 52, namely, the brush charger 2 vibrates in the axial direction of the photoreceptor drum 1 as indicated by the arrow of FIG. 22. In the case where the brush charger 2 which vibrates in such a manner is provided, a satisfactory image can be obtained, and the service life of the brush charger 2 can be prolonged.

In other words, in the image forming apparatus where the contact charging method adopting the cleanerless process is utilized by the brush charger 2, in the case where the brush charger 2 is fixed, transfer-residual toner, sheet powder, etc. are easily stored in local places between the charger and the photoreceptor drum 1. The charging state is not uniform between the local places where transfer-residual toner, sheet powder, etc. are stored, and another places. As a result, since an amount of toner returning from the brush charger 2 to the photoreceptor increases in the local places, defects on an image, such as a blotted section and a void section due to shielding of lights at the time of exposure, are frequently produced. For the above reasons, it is difficult to prolong the service life of the fixed brush charger 2.

Therefore, like the image forming apparatus of the present invention, when the brush driving unit 51 vibrates the brush charger 2, transfer-residual toner, sheet powder, etc. are dispersed on the surface of the photoreceptor 1. As a result, storing of transfer-residual toner, sheet powder, etc. in local places is decreased. Therefore, generation of uneven charging due to transfer-residual toner, sheet powder, etc. is delayed, an amount of toner, which returns from the brush charger 2 to the photoreceptor drum 1 is averaged on the surface of the photoreceptor drum 1, thereby delaying generation of a defective image, such as a blotted section and a void section on an image. As a result, the service life of the brush charger 2 can be prolonged.

In addition, in the case where the brush driving unit 51 is provided, irregularity of charging by the brush charger 2, namely, so called brush-striped charging state can be eliminated. Moreover, since a function in agitating transfer-residual toner is improved, so-called memory phenomenon is also eliminated. Images were formed by brush charging using the brush vibrating method, and the formed images were examined. Satisfactory images could be obtained after the image forming operation on the 10,000th sheet as well as on early sheets.

[EMBODIMENT 7]

The following describes still another embodiment in reference to FIGS. 23 through 27. Here, for convenience of explanation, those members that have the same arrangement and functions, and that are described in the aforementioned embodiments are indicated by the same reference numerals and the description thereof is omitted.

Figure 23:
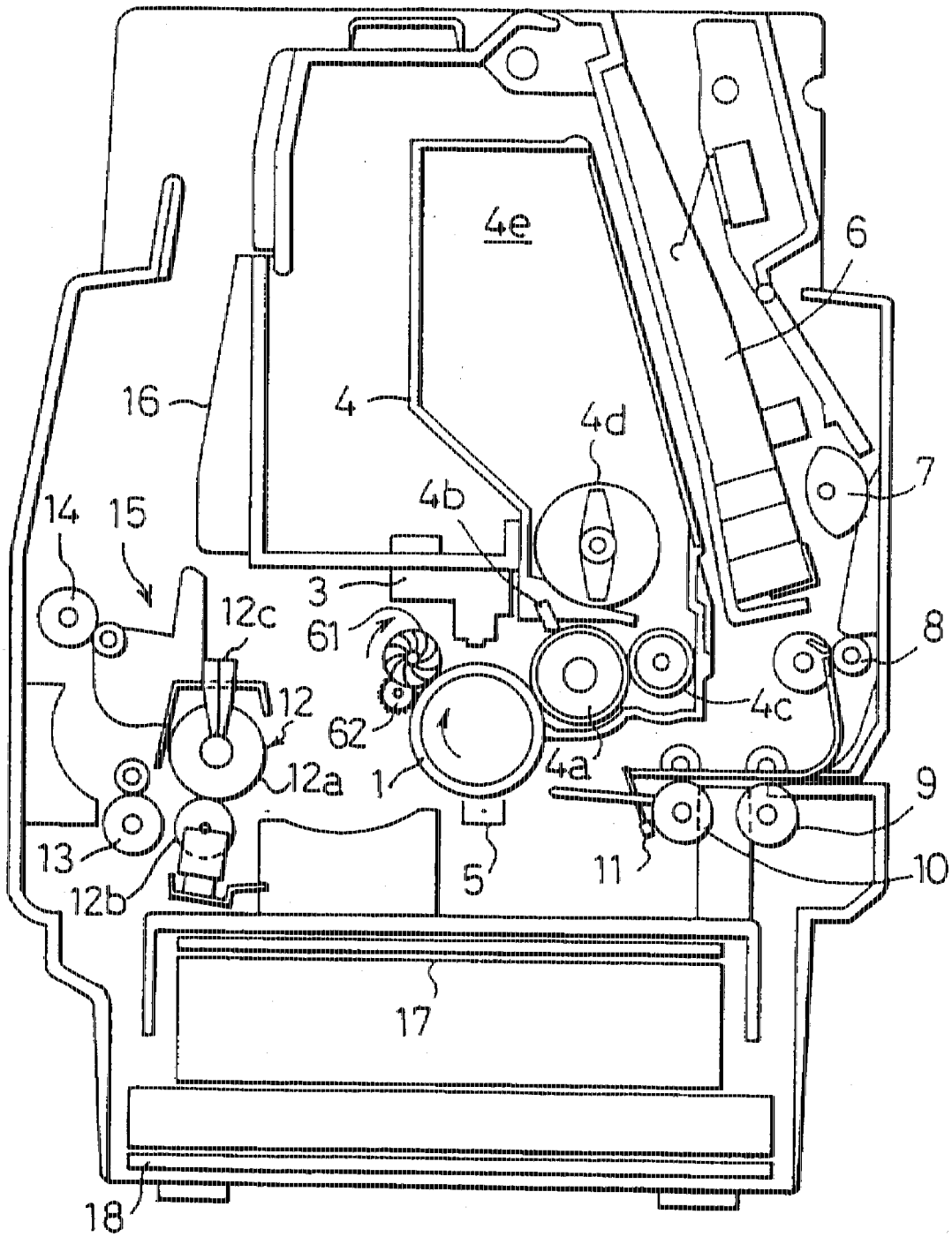
FIG. 23 is a front view which shows an overall arrangement of an image forming apparatus according to still another embodiment of the present invention.

As shown in FIG. 23, the image forming apparatus of the present embodiment is provided with a roller-type brush charger 61, which is a brush charging member, instead of the brush charger 2 in the image forming apparatus shown in FIG. 2. The brush charger 61 has a gear section, not shown, for example, and when an idle gear 62, which transmits the rotation of the photoreceptor drum 1, is engaged with the gear section, the brush charger 61 rotates in cynchronization with the rotation of the photoreceptor drum 1. The rotating direction of the brush charger 61 is same as the rotating direction of the photoreceptor drum 1, and its peripheral speed is approximately equal to the peripheral speed of the photoreceptor drum 1.

Figure 24A:
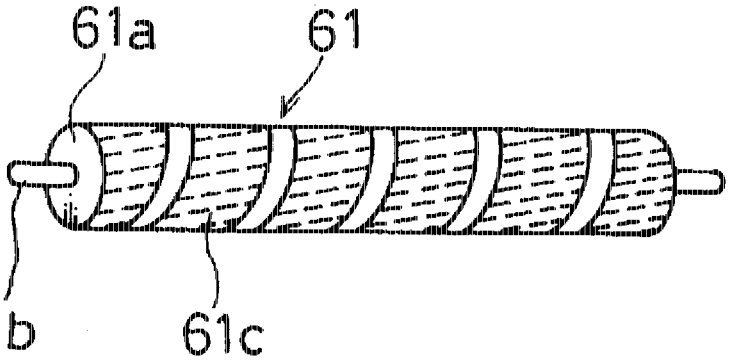
FIG. 24(*a*) is a perspective view of the brush charger shown in FIG. 23.
Figure 24B:
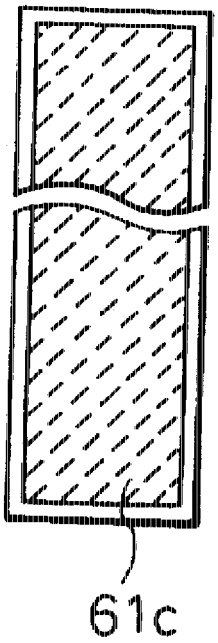

The brush charger 61 has a shape shown in FIG. 24(*a*), and it is formed so that electrically conductive cloth 61*c* is spirally wound around a base section 61*a*, which is a cylindrical core section with an electrically conductive shaft 61*b*. The electrically conductive cloth 61*c* is formed so that a lot of electrically conductive fibers are planted perpendicularly to the face of the cloth.

In accordance with the arrangement of the present embodiment, similarly to the arrangement that the brush driving unit 51 described in embodiment 6 vibrates the brush charger 2, since the roller-type brush charger 61 is used as mentioned above, transfer-residual toner, sheet powder, etc. are dispersed on the surface of the photoreceptor drum 1. As a result, an amount of transfer-residual toner, sheet powder, etc. stored in some specified places is decreased, the photoreceptor drum 1 can be uniformly charged. Therefore, defects, such as a blotted section and a void section, are seldom generated on an image, so the service life of the brush charger 61 can be prolonged.

In addition, compared to the arrangement of embodiment 6, the arrangement of the present embodiment does not require independent driving means which drives the brush charger 61, such as the motor 53 for vibrating, so the cost can be lowered.

The brush charger 61 uses the electrically conductive cloth 61*c* on which electrically conductive fibers are perpendicularly planted, but furthermore, in the case where the electrically conductive fibers are slanted, more satisfactory image can be obtained.

Figure 25A:
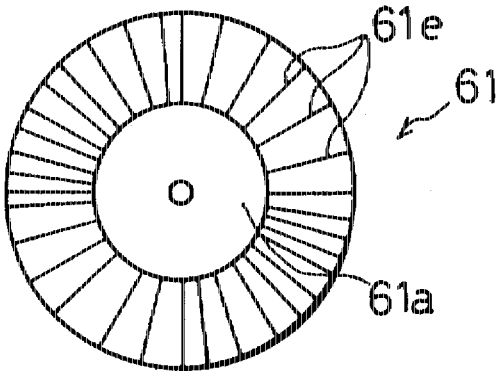
FIG. 25(*a*) is a side view of the brush charger shown in FIG. 24(*a*).
Figure 25B:
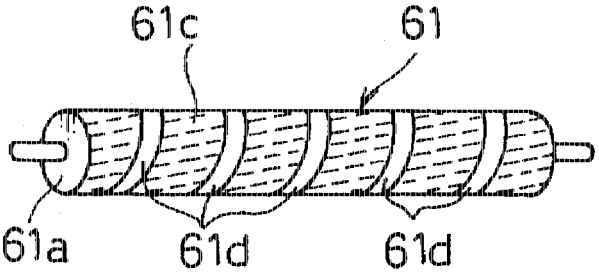
Figure 26:
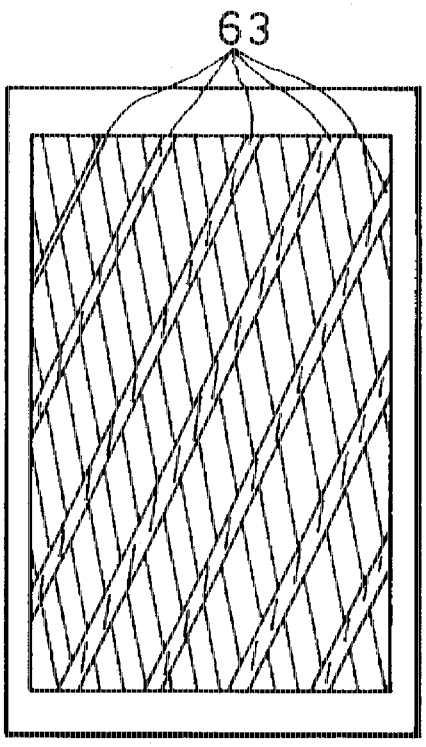
FIG. 26 is an explanatory drawing which shows an example of generation of a faulty image by the brush charger with the above winding pattern.

In other words, as shown in FIGS. 25(*a*) and 25(*b*) which is side views, in the case where the brush charger 61 is formed by winding the electrically conductive cloth 61*c*, on which the electrically conductive fibers 61*e* are perpendicularly planted, around the base section 61*a*, a gap is easily formed in portions corresponding to winding boundary 61*d*. Since density of the electrically conductive fibers 61*e* is low thereon, the photoreceptor area, which comes contact with the winding boundary 61*d*, is easily charged improperly. If the improper charge is remarkable, a striped pattern 63 shown in FIG. 26 can be generated on an image.

Figure 27A:
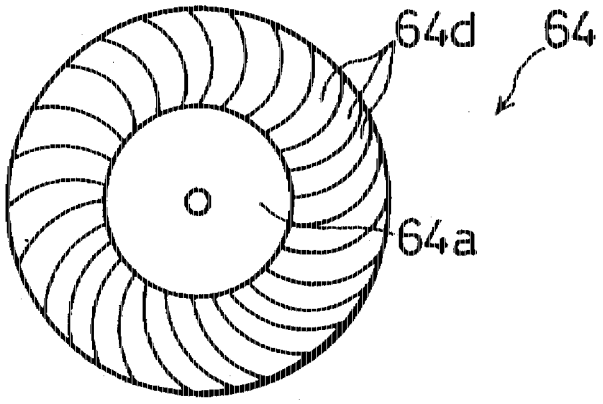
FIG. 27(*a*) is a side view which shows another example of the brush charger shown in FIG. 27(*a*) in which fibers are slanted.
Figure 27B:
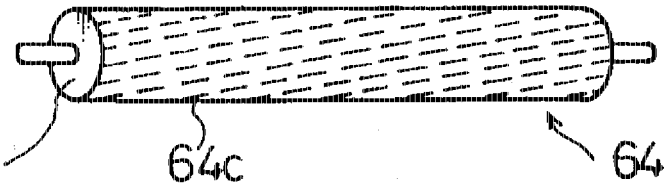
Figure 28:
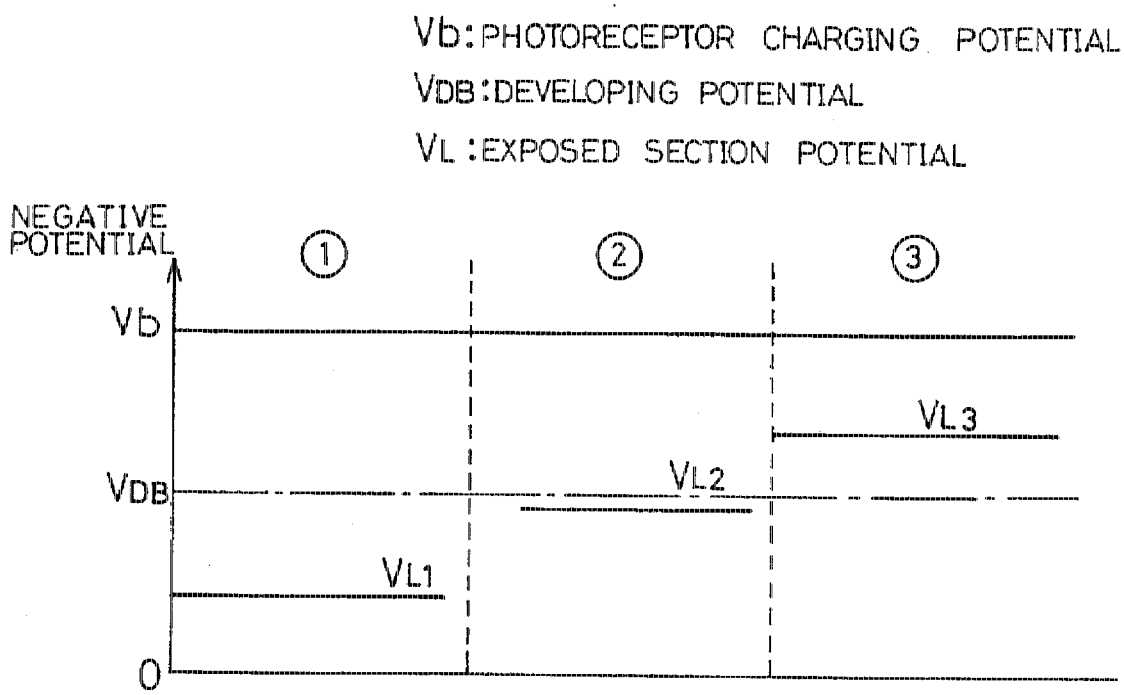
FIG. 28 is an explanatory drawing which shows a relationship among an amount of transfer-residual toner, a exposed portion potential, a developing potential and a photoreceptor charging potential on a photoreceptor in a conventional image forming apparatus.
Figure 29:
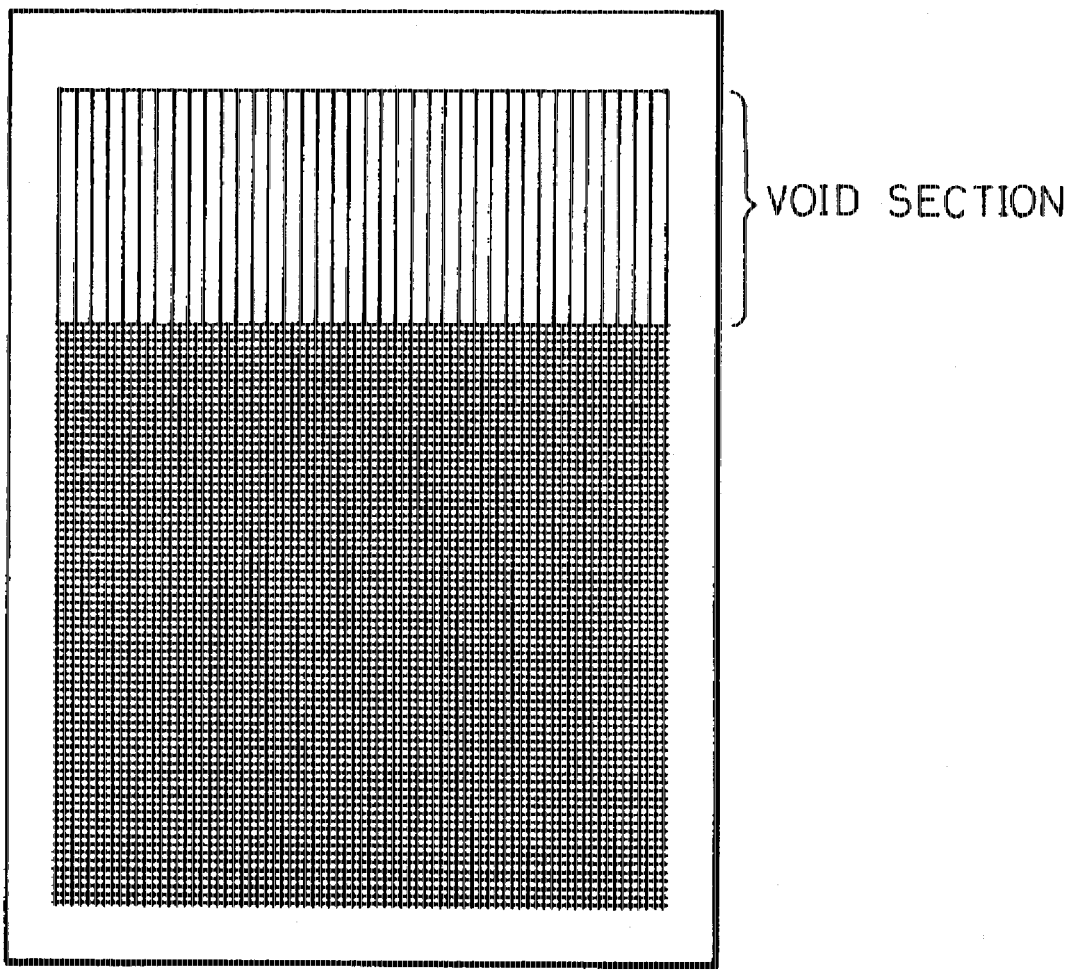
FIG. 29 is an explanatory drawing which shows an example of a void section which is a fault on an image caused in the conventional image forming apparatus.
Figure 30:
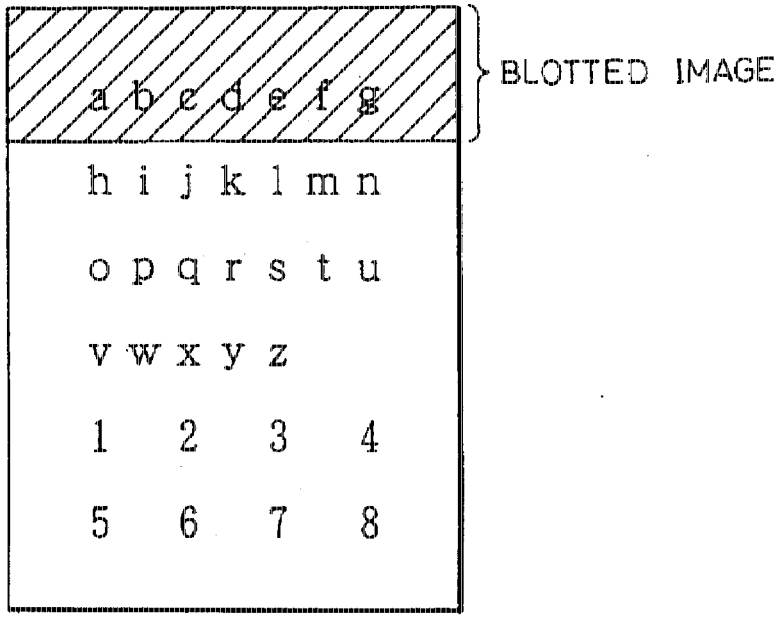
FIG. 30 is an explanatory drawing which shows an example of a blotted section on an image which is a fault on an image caused in the conventional image forming apparatus.

Therefore, when the brush charger 64, in which the electrically conductive fibers 64*d* are slanted as shown in FIGS. 27(*a*) and 27(*b*), is used instead of the brush charger 61, such a problem can be solved. The brush charger 64 is formed so that an electrically conductive cloth 64*c* is wound around a base section 64*a* in the same manner as that of the brush charger 61. However, when electrically conductive fibers 64*d* are slanted in the opposite direction to the rotating direction of the brush charger 64 as shown in FIG. 27(*a*) which is a side view, winding boundaries are covered by the electrically conductive fibers 64*d*, so density of the electrically conductive fibers 64*d* on the outer surface of the brush charger 64 becomes substantially uniform. As a result, the photoreceptor drum 1 can be uniformly charged, and thus defects on an image, such as the striped pattern 63, can be prevented from being generated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

a photosensitive image holder;

charging means for giving charge to a surface of said image holder through a contact charging member, which contacts with said image holder, so as to charge the surface of said image holder;

exposing means for forming an electrostatic latent image by emitting a light to the surface of said charged image holder;

development cleaning means for supplying a developer to the electrostatic latent image on said image holder so as to develop the electrostatic latent image and for collecting developer remaining on the surface of said image holder;

transfer means; and voltage applying means, wherein said transfer means transfers a developer image on said image holder, which is obtained by the developing process by means of said development cleaning means, onto a transferred material using a voltage from said voltage applying means, wherein when a transferred material exists in a transfer position between said image holder and said transfer means during image forming operation, said voltage applying means applies a transfer voltage, which is used for transferring the developer image on said image holder onto the transferred material and which has an opposite polarity to that of a voltage applied to said contact charging member, to said transfer means, and when a transferred material does not exist in the transfer position during image forming operation, said voltage applying means applies a non-transfer voltage, which is lower than the transfer voltage, to said transfer means.

2. The image forming apparatus as defined in claim 1, wherein said voltage applying means grounds said transfer means so as to apply the non-transfer voltage to said transfer means.

3. The image forming apparatus as defined in claim 1, wherein said voltage applying means brings said transfer means into a floating state so as to apply the non-transfer voltage to said transfer means.

4. The image forming apparatus as defined in claim 1, wherein said transfer means is provided so as to contact with said image holder and makes a transferred material positioned between said transfer means and said image holder contact with said image holder so as to transfer the development image onto the transferred material.

5. The image forming apparatus as defined in claim 1, wherein the surface of said image holder moves in a first direction and said contact charging member is composed of a brush charging member having an electrically conductive brush which contacts with the surface of said image holder, said image forming apparatus further comprising brush vibrating means which vibrates the brush charging member in a direction which perpendicularly intersects said first direction of the surface of said image holder and in a direction which is parallel with the surface of said image holder.

6. The image forming apparatus as defined in claim 1, wherein said contact charging member is composed of a brush charging member having a roller-like electrically conductive brush rotating in one direction with it contacting with the surface of said image holder, said brush charging member being formed so that a band-like brush obtained by perpendicularly planting electrically conductive fibers is wound around a base material, said electrically conductive fibers being slanted in the opposite direction to the rotating direction of said brush charging member.

7. The image forming apparatus as defined in claim 1, wherein a voltage to be applied to said contact charging member is an oscillating voltage, a peak-to-peak voltage of the oscillating voltage being set lower than twice a discharge starting voltage between said image holder and said contact charging member.

8. An image forming apparatus, comprising:

a photosensitive image holder;

charging means for giving charge to a surface of said image holder through a contact charging member, which contacts with said image holder, so as to charge the surface of said image holder;

exposing means for forming an electrostatic latent image by emitting a light to the surface of said charged image holder;

development cleaning means for supplying a developer to the electrostatic latent image on said image holder so as to develop the electrostatic latent image and for collecting developer remaining on the surface of said image holder;

transfer means; and voltage applying means, wherein said transfer means transfers a developer image on said image holder, which is obtained by the developing process by means of said development cleaning means, onto a transferred material using a voltage from said voltage applying means, wherein when a transferred material exists in a transfer position between said image holder and said transfer means during image forming operation, said voltage applying means applies a transfer voltage, which is used for transferring the developer image on said image holder onto the transferred material and which has an opposite polarity to that of a voltage applied to said contact charging member, to said transfer means, and when a transferred material does not exist in the transfer position during image forming operation, said voltage applying means applies a non-transfer voltage of not lower than 0V, which has opposite polarity to that of the transfer voltage, to said transfer means.

9. The image forming apparatus as defined in claim 8, wherein the non-transfer voltage, which has opposite polarity to that of the transfer voltage to be applied to said transfer means by said voltage applying means, is set so that a charging potential by the non-transfer voltage becomes lower than a charging potential by said charging means on said image holder, which has passed the transfer position of said transfer means.

10. The image forming apparatus as defined in claim 8, wherein said transfer means is provided so as to contact with said image holder and makes a transferred material positioned between said transfer means and said image holder contact with said image holder so as to transfer the development image onto the transferred material.

11. The image forming apparatus as defined in claim 10, wherein said voltage applying means uses a power source for said charging means so as to apply the non-transfer voltage having opposite polarity to that of the transfer voltage.

12. The image forming apparatus as defined in claim 10, wherein said voltage applying means uses a power source for the developing process so as to apply the non-transfer voltage having opposite polarity to that of the transfer voltage.

13. The image forming apparatus as defined in claim 8, wherein the surface of said image holder moves in a first direction and said contact charging member is composed of a brush charging member having an electrically conductive brush which contacts with the surface of said image holder, said image forming apparatus further comprising brush vibrating means which vibrates the brush charging member in a direction which perpendicularly intersects said first direction of the surface of said image holder and in a direction which is parallel with the surface of said image holder.

14. The image forming apparatus as defined in claim 8, wherein said contact charging member is composed of a brush charging member having a roller-like electrically conductive brush rotating in one direction with it contacting with the surface of said image holder, said brush charging member being formed so that a band-like brush obtained by perpendicularly planting electrically conductive fibers is wound around a base material, said electrically conductive fibers being slanted in the opposite direction to the rotating direction of said brush charging member.

15. The image forming apparatus as defined in claim 8, wherein a voltage to be applied to said contact charging member is an oscillating voltage, a peak-to-peak voltage of the oscillating voltage being set lower than twice a discharge starting voltage between said image holder and said contact charging member.

16. An image forming apparatus, comprising:

a photosensitive image holder;

charging means for giving charge to a surface of said image holder through a contact charging member, which contacts with said image holder, so as to charge the surface of said image holder;

exposing means for forming an electrostatic latent image by emitting a light to the surface of said charged image holder;

development cleaning means for supplying a developer to the electrostatic latent image on said image holder so as to develop the electrostatic latent image and for collecting a developer remaining on the surface of said image holder;

transfer means for transferring a developer image on said image holder, which is obtained by the developing process by means of said development cleaning means, onto a transferred material; and control means for controlling movement of said image holder so that a contact position on said image holder with said contact charging member passes a counter position to said development cleaning means at least once at starting of the image forming operation.

17. The image forming apparatus as defined in claim 16, wherein the surface of said image holder moves in a first direction and said contact charging member is composed of a brush charging member having an electrically conductive brush which contacts with the surface of said image holder, said image forming apparatus further comprising brush vibrating means which vibrates the brush charging member in a direction which perpendicularly intersects said first direction of the surface of said image holder and in a direction which is parallel with the surface of said image holder.

18. The image forming apparatus as defined in claim 16, wherein said contact charging member is composed of a brush charging member having a roller-like electrically conductive brush rotating in one direction with it contacting with the surface of said image holder, said brush charging member being formed so that a band-like brush obtained by perpendicularly planting electrically conductive fibers is wound around a base material, said electrically conductive fibers being slanted in the opposite direction to the rotating direction of said brush charging member.

19. The image forming apparatus as defined in claim 16, wherein a voltage to be applied to said contact charging member is an oscillating voltage, a peak-to-peak voltage of the oscillating voltage being set lower than twice a discharge starting voltage between said image holder and said contact charging member.

* * * * *